US010108129B2

(12) United States Patent
Yamaguchi et al.

(10) Patent No.: US 10,108,129 B2
(45) Date of Patent: Oct. 23, 2018

(54) MEMBER FOR ELECTROPHOTOGRAPHY AND METHOD OF PRODUCING THE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Sosuke Yamaguchi, Yokohama (JP); Masaki Yamada, Mishima (JP); Hideya Arimura, Suntou-gun (JP); Kazuhiro Yamauchi, Suntou-gun (JP); Satoru Nishioka, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 258 days.

(21) Appl. No.: 14/973,505

(22) Filed: Dec. 17, 2015

(65) Prior Publication Data

US 2016/0187809 A1 Jun. 30, 2016

(30) Foreign Application Priority Data

Dec. 26, 2014 (JP) ..... 2014-265946

(51) Int. Cl.
*B05D 3/02* (2006.01)
*G03G 15/08* (2006.01)
*G03G 15/00* (2006.01)

(52) U.S. Cl.
CPC ..... *G03G 15/75* (2013.01); *B05D 3/0254* (2013.01); *G03G 15/0808* (2013.01); *G03G 2215/00957* (2013.01)

(58) Field of Classification Search
None
See application file for complete search history.

(56) References Cited

U.S. PATENT DOCUMENTS 5,403,692 A 4/1995 Yokokawa et al.
5,925,893 A 7/1999 Ishii et al.
(Continued)

FOREIGN PATENT DOCUMENTS

CN 102163015 A 8/2011
EP 2 950 154 A1 12/2015
(Continued)

OTHER PUBLICATIONS

European Search Report dated Mar. 7, 2016 in European Application No. 15202289.3.
U.S. Appl. No. 14/973,545, filed Dec. 17, 2015, Inventor(s): Yamada et al.

*Primary Examiner* — Ramsey Zacharia
(74) *Attorney, Agent, or Firm* — Fitzpatrick Cella Harper and Scinto

(57) ABSTRACT

Provided is a member for electrophotography that is not reduced in charge-providing performance even by its long-term storage and use under a high-temperature and high-humidity environment, and is hence conducive to the formation of a high-quality electrophotographic image. The member for electrophotography includes: an electroconductive substrate; and an electroconductive layer, in which: the electroconductive layer contains a resin having a cationic organic group in a molecule thereof and an anion; a total sum of contents of an alkali metal and an alkali earth metal in the electroconductive layer is 500 ppm or less; and the anion includes at least one selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion.

20 Claims, 3 Drawing Sheets

(56) References Cited

U.S. PATENT DOCUMENTS

| | | | | |
|---|---|---|---|---|
| 5,978,639 | A * | 11/1999 | Masuda | G03G 15/162 399/302 |
| 8,668,987 | B2 | 3/2014 | Yamauchi et al. | |
| 8,852,743 | B2 | 10/2014 | Kikuchi et al. | |
| 9,639,009 | B2 * | 5/2017 | Yamaguchi | G03G 5/043 |
| 2012/0263499 | A1 * | 10/2012 | Yamauchi | G03G 15/0233 399/176 |
| 2013/0281275 | A1 | 10/2013 | Nishioka et al. | |
| 2014/0221184 | A1 | 8/2014 | Arimura et al. | |
| 2014/0287899 | A1 | 9/2014 | Nishioka et al. | |
| 2015/0198900 | A1 | 7/2015 | Yamada et al. | |
| 2015/0227074 | A1 | 8/2015 | Ito et al. | |
| 2015/0331339 | A1 | 11/2015 | Yamada et al. | |
| 2015/0331340 | A1 | 11/2015 | Nishioka et al. | |
| 2015/0331341 | A1 | 11/2015 | Yamaguchi et al. | |
| 2015/0331342 | A1 | 11/2015 | Yamaguchi et al. | |
| 2015/0331343 | A1 | 11/2015 | Yamada et al. | |
| 2015/0331346 | A1 | 11/2015 | Yamauchi et al. | |
| 2015/0331347 | A1 | 11/2015 | Arimura et al. | |

FOREIGN PATENT DOCUMENTS

| | | | |
|---|---|---|---|
| JP | 57-5047 | A | 1/1982 |
| JP | 10-175264 | A | 6/1998 |
| JP | 2005-120158 | A | 5/2005 |
| JP | 2007-297438 | A | 11/2007 |
| JP | 2011-118113 | A | 6/2011 |

* cited by examiner

MEMBER FOR ELECTROPHOTOGRAPHY AND METHOD OF PRODUCING THE MEMBER, PROCESS CARTRIDGE, AND ELECTROPHOTOGRAPHIC APPARATUS

BACKGROUND OF THE INVENTION

Field of the Invention

The present invention relates to a member for electrophotography to be used in an electrophotographic apparatus and a method of producing the member, and to a process cartridge and an electrophotographic apparatus each including the member for electrophotography.

Description of the Related Art

In a member for electrophotography including an electroconductive layer to be used in a developing roller, a charging roller, a developer-regulating member, or a cleaning blade in an electrophotographic apparatus, the electric resistance value of the electroconductive layer needs to be controlled to from about $10^5\Omega$ to about $10^9\Omega$. As an electroconductive agent to be used for controlling the electric resistance value of the electroconductive layer within the range, there is known an ionic electroconductive agent, such as a quaternary ammonium salt. An electroconductive layer that is made electroconductive by the ionic electroconductive agent can be reduced in unevenness of its electric resistance value resulting from the dispersion unevenness of the electroconductive agent as compared to an electroconductive layer that is made electroconductive by an electronic electroconductive agent including carbon black. Accordingly, in the developing roller, an image on a photosensitive member can be uniformly developed with a developer, and in the charging roller, the surface of the photosensitive member can be uniformly charged.

However, the ionic electroconductive agent has a migration property, and hence the ionic electroconductive agent is liable to move in the electroconductive layer to bleed to the surface of the member for electrophotography owing to its long-term use. As a result, the ionic electroconductive agent that has bled to the surface may adhere to the surface of, for example, the photosensitive member abutting with the member for electrophotography to reduce the quality of an electrophotographic image.

To cope with the problem, Japanese Patent Application Laid-Open No. H10-175264 describes an electroconductive member having the following characteristic. A polyurethane ionomer is incorporated into the electroconductive member to prevent the contamination of a body to be charged due to the bleeding of a migratory component. In addition, in Japanese Patent Application Laid-Open No. 2011-118113, the bleeding of an ionic electroconductive agent is suppressed by using an ionic liquid having 2 hydroxyl groups and fixing the ionic liquid in a urethane resin.

The present invention is directed to providing a member for electrophotography that is not reduced in charge-providing performance even by its long-term storage and use under a high-temperature and high-humidity environment, and is hence conducive to the formation of a high-quality electrophotographic image, and a method of producing the member.

The present invention is also directed to providing an electrophotographic image forming apparatus that can stably output a high-quality electrophotographic image and a process cartridge to be used in the apparatus.

SUMMARY OF THE INVENTION

According to one embodiment of the present invention, there is provided a member for electrophotography, including:

an electroconductive substrate; and an electroconductive layer, in which:

the electroconductive layer contains a resin having a cationic organic group in a molecule thereof and an anion;

a total sum of contents of an alkali metal and an alkali earth metal in the electroconductive layer is 500 ppm or less; and the anion includes at least one selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion.

Further, according to another embodiment of the present invention, there is provided a member for electrophotography, including:

an electroconductive substrate; and an electroconductive layer, in which:

the electroconductive layer contains one of the following resin (a) and resin (b); and a total sum of contents of an alkali metal and an alkali earth metal in the electroconductive layer is 500 ppm or less:

Resin (a):

a resin that is synthesized from an ionic electroconductive agent and a first compound capable of reacting with a hydroxyl group, the ionic electroconductive agent containing an anion and a cation having 2 or more hydroxyl groups, the anion including at least one selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion; and Resin (b):

a product of a reaction between a second compound having 3 or more nitrogen atoms of a tertiary amine in a molecule thereof, and a third compound having, in a molecule thereof, 2 or more groups of at least one of kinds represented by $—N(SO_2R^1)_2$ and $—OSO_2R^2$ where $R^1$ and $R^2$ each independently represent a fluorine atom or a perfluoroalkyl group having 1 to 5 carbon atoms.

According to another embodiment of the present invention, there is provided a process cartridge, including members for electrophotography, the process cartridge being removably mounted onto a main body of an electrophotographic apparatus, in which at least one of the members for electrophotography includes the above-mentioned member for electrophotography.

According to another embodiment of the present invention, there is provided an electrophotographic apparatus, including members for electrophotography, in which at least one of the members for electrophotography includes the above-mentioned member for electrophotography.

According to yet another embodiment of the present invention, there is provided a method of producing a member for electrophotography, the member for electrophotography including an electroconductive substrate and an electroconductive layer on the substrate, the electroconductive layer containing a resin having a cationic organic group in a molecule thereof and an anion, the electroconductive layer containing an alkali metal and an alkali earth metal at a total sum of contents of 500 ppm or less, the anion including at least one selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion, the method including:

(1) forming, on the electroconductive substrate, a coating film of a paint containing a cation having 2 or more hydroxyl groups and a compound capable of reacting with a hydroxyl group; and (2) causing the cation having 2 or more hydroxyl groups and the compound capable of reacting with a hydroxyl group in the coating film to react with each other to form the electroconductive layer.

According to yet another embodiment of the present invention, there is provided a method of producing a member for electrophotography, the member for electrophotography including an electroconductive substrate and an electroconductive layer on the substrate, the electroconductive layer containing a resin having a cationic organic group in a molecule thereof and an anion, the electroconductive layer containing an alkali metal and an alkali earth metal at a total sum of contents of 500 ppm or less, the anion including at least one selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion, the method including:

forming, on the electroconductive substrate, a coating film of a paint containing a compound having 3 or more nitrogen atoms of a tertiary amine, and a compound having, in a molecule thereof, 2 or more groups of at least one of kinds represented by $—N(SO_2R^1)_2$ and $—OSO_2R^2$ where $R^1$ and $R^2$ each independently represent a fluorine atom or a perfluoroalkyl group having 1 to 5 carbon atoms; and causing the compound having 3 or more nitrogen atoms of a tertiary amine, and the compound having, in a molecule thereof, 2 or more groups of at least one of kinds represented by $—N(SO_2R^1)_2$ and $—OSO_2R^2$ where $R^1$ and $R^2$ each independently represent a fluorine atom or a perfluoroalkyl group having 1 to 5 carbon atoms in the coating film to react with each other to form the electroconductive layer.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Investigations made by the inventors of the present invention have confirmed that according to the inventions according to Japanese Patent Application Laid-Open No. H10-175264 and Japanese Patent Application Laid-Open No. 2011-118113, the bleeding of an ionic electroconductive agent from an electroconductive layer can be effectively suppressed without any reduction in electroconductivity of the electroconductive layer. However, the inventors have found that a developing member and a charging member to which technologies according to Japanese Patent Application Laid-Open No. H10-175264 and Japanese Patent Application Laid-Open No. 2011-118113 have been applied need to be additionally improved because when the members are left to stand under a high-temperature and high-humidity environment for a long time period, their electric resistances may still fluctuate.

In view of the foregoing, the inventors of the present invention have made extensive investigations for solving the problems. As a result, the inventors have found that a member for electrophotography including an electroconductive layer in which the content of a specific metal component is small shows high charge-providing performance even after having been left to stand under a high-temperature and high-humidity environment for a long time period.

Figure 1A:
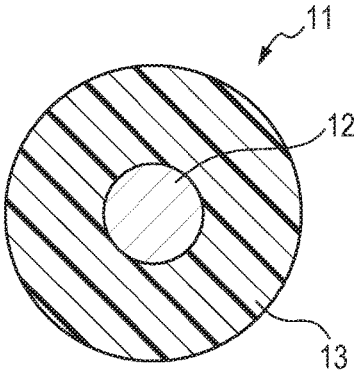
FIG. 1A is a conceptual view for illustrating an example of a member for electrophotography according to the present invention.
Figure 1B:
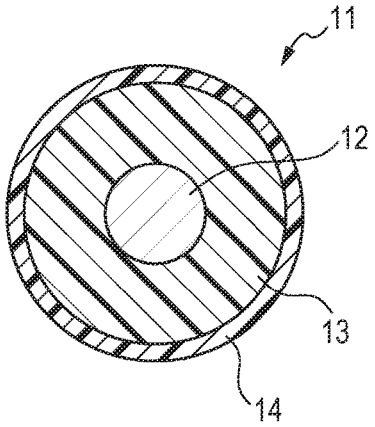
FIG. 1B is a conceptual view for illustrating an example of the member for electrophotography according to the present invention.

A member for electrophotography according to one embodiment of the present invention is illustrated in each of FIG. 1A and FIG. 1B. As illustrated in FIG. 1A, a member 11 for electrophotography according to the present invention can be formed of an electroconductive substrate 12 and an elastic layer 13 arranged on its outer periphery. In this case, the elastic layer 13 is an electroconductive layer containing a resin and an anion according to the present invention. In addition, as illustrated in FIG. 1B, a surface layer 14 may be formed on the surface of the elastic layer 13. In this case, the surface layer 14 is the electroconductive layer containing the resin and the anion according to the present invention.

[Substrate]

The substrate 12 functions as an electrode and support member for the member for electrophotography, is formed of, for example, an electroconductive material, such as: a metal or an alloy like aluminum, a copper alloy, or stainless steel; iron subjected to plating treatment with chromium or nickel; or a synthetic resin having electroconductivity, and may be a solid body or a hollow body.

[Electroconductive Layer]

The electroconductive layer contains a resin having a cationic organic group in a molecule thereof and an anion. The anion is at least one selected from a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion. Further, the total sum of the contents of an alkali metal and an alkali earth metal in the electroconductive layer is 500 ppm or less.

The resin having a cationic organic group in a molecule thereof according to the present invention is preferably synthesized by, for example, any one of the following "method (J-1)" and "method (J-2)":

Method (J-1): a reaction between a cation having 2 or more hydroxyl groups (hereinafter sometimes referred to as "material 11") and a first compound capable of reacting with a hydroxyl group (hereinafter sometimes referred to as "material 12"); and Method (J-2): a reaction between a second compound having 3 or more nitrogen atoms of a tertiary amine (hereinafter sometimes referred to as "amine compound") and a third compound having a plurality of substituents each represented by the following chemical formula (5-1) or (5-2) (hereinafter sometimes referred to as "anion precursor").

$$—N(SO_2R^1)_2 \quad \text{Chemical formula (5-1)}$$

$$—OSO_2R^2 \quad \text{Chemical formula (5-2)}$$

In the chemical formulae (5-1) and (5-2), $R^1$ and $R^2$ each independently represent a fluorine atom or a perfluoroalkyl group having 1 to 5 carbon atoms.

When the resin having a cationic organic group in a molecule thereof is formed by the method (J-1), a portion derived from the cation serving as the "material 11" serves as the cationic organic group. When the resin having a cationic organic group in a molecule thereof is formed by the method (J-2), a portion derived from the amine compound is the cationic organic group.

For example, an amine compound reacted by a reaction as shown in the formula (6) to be described later, and a portion after the quaternization of the amine compound through the reaction is the cationic organic group.

In the present invention, the "resin having a cationic organic group in a molecule thereof" is used, and the resin having a cationic organic group in a molecule thereof can be provided when the "material 11" and/or the "material 12" each contain/contains a resin component, or are each/is a polymerizable monomer. In addition, the resin having a cationic organic group in a molecule thereof can be provided when the "amine compound" and/or the "anion precursor" each contain/contains a resin component, or are each/is a polymerizable monomer.

The inventors of the present invention have assumed the reason why a significant effect is exhibited on the charge-providing performance of the electroconductive layer by incorporating the resin having a cationic organic group in a molecule thereof and the anion into the electroconductive layer, and reducing the amounts of the alkali metal and the alkali earth metal in the electroconductive layer to be as described below.

First, the provision of charge to a developer by the electroconductive layer may be performed mainly by triboelectric charging between the developer and the surface of the electroconductive layer. Accordingly, the charge-providing performance of the electroconductive layer is significantly affected by the kind of a compound present on the surface of the electroconductive layer.

In addition, in the electroconductive layer, the cationic organic group and the anion may attract each other through their respective electrostatic attractions to exist as a pair. Accordingly, it has been assumed that when the cationic organic group is caused to react with the resin to be incorporated into the skeleton of the resin, the anion does not migrate to the surface of the electroconductive layer because the anion exists while forming a pair with a cation.

On the other hand, when the cationic organic group is incorporated into the resin skeleton, the moving range of the cationic organic group is limited and hence the electroconductivity of the electroconductive layer does not reach a desired value in some cases. In view of the foregoing, when a fluorine atom having a high electronegativity is introduced into the anion, the negative charge of the anion is delocalized and hence its interaction with the cationic organic group can be weakened. As a result, the anion can easily move without being bound by the cationic organic group and hence the desired electroconductivity can be achieved.

However, investigations made by the inventors of the present invention have found that when an electroconductive layer containing a specific ionic electroconductive agent is applied to a member for electrophotography, its charge-providing performance after the member has been left to stand under a high-temperature and high-humidity environment for a long time period may significantly reduce.

In view of the foregoing, the inventors have further continued their investigations. Thus, the inventors have obtained the following unexpected result: the presence of trace amounts of an alkali metal and an alkali earth metal in the electroconductive layer has a significant influence on a reduction in charge-providing performance of the member for electrophotography. Specifically, the inventors have found that when the cation of each of the alkali metal and the alkali earth metal in the electroconductive layer, and an anion containing a fluorine atom form a pair, a produced salt is liable to migrate (bleed) to the surface of the electroconductive layer, thereby affecting the charge-providing performance.

<Migration Property of Salt Formed of Cation and Anion in Electroconductive Layer>

An influence of the kind of each of the cation and the anion on the migration property of the produced salt (pair of the cation and the anion) is described below.

First, a relationship between the cation and the migration property is described. The cation interacts with a functional group in the resin. As the interaction between the cation and the functional group in the resin enlarges, the extent to which the cation is bound by the resin enlarges, its mobility reduces, and hence it becomes more difficult for the cation to migrate to the surface of the electroconductive layer. On the other hand, as the interaction between the cation and the resin reduces, the cation can move without being bound by the resin and is hence more liable to migrate to the surface of the electroconductive layer.

Based on the hard and soft acids and bases (HSAB) principle, the interaction between the cation and the functional group in the resin is considered to be as described below. According to the classification of the HSAB principle, alkali metals and alkali earth metals (such as lithium, sodium, and magnesium) are classified into hard acids because the metals have high charge densities and small polarizabilities. On the other hand, quaternary ammonium cations and transition metal cations are classified into soft acids because the cations have relatively low charge densities and large polarizabilities. The same holds true for bases: a chloride ion and a hydroxide ion are classified into hard bases, and a double bond, an aromatic ring, and the like are classified into soft bases. According to the HSAB principle, a hard acid can easily interact with a hard base, and a soft acid can easily interact with a soft base.

In other words, an alkali metal or alkali earth metal classified into a hard acid shows a smaller interaction with the functional group (such as a double bond like a carbonyl group or an aromatic ring) in the resin serving as a soft base than a quaternary ammonium cation or transition metal ion serving as a soft acid does. Accordingly, it is assumed that the cation of the alkali metal or the alkali earth metal is hardly bound by the resin and is hence liable to migrate to the surface of the electroconductive layer.

Next, a relationship between the kind of the anion and the migration property is described. Investigations made by the inventors of the present invention have revealed that the presence or absence of a fluorine atom in the anion has a large influence on the migration property of the salt that has formed a pair with the cation. The reason for the foregoing is considered to be as described below. That is, unlike an anion free of any fluorine atom, such as a chloride ion, a perchlorate anion, or an alkyl sulfonate anion, a fluorosulfonate anion or a fluorosulfonylimide anion has a fluorine atom having a high electronegativity and hence the polarizability of a bond containing the fluorine atom is small. Accordingly, the intermolecular force of the anion weakens and hence the surface free energy of the salt that has formed a pair with the cation reduces. As a result, a force for reducing the surface free energy of the salt at an air interface acts to facilitate the migration to the surface of the electroconductive layer.

As described above, both the kind of the cation and the kind of the anion affect the migration property of the produced salt to the surface of the electroconductive layer. Accordingly, it is assumed that when the cation of the alkali metal or the alkali earth metal and the anion containing a fluorine atom form a pair, the produced ion pair is particularly liable to bleed because of their respective synergistic effects.

The foregoing has revealed that conditions necessary for maintaining the electroconductivity and charge-providing performance of the electroconductive layer over a long time period are to incorporate the anion having a fluorine atom, and to reduce the amounts of the alkali metal and the alkali earth metal incorporated in trace amounts into the electroconductive layer.

<Ionic Electroconductive Agent>

An ionic electroconductive agent is constituted of the "material 11" serving as a raw material for the cationic organic group and an anion.

The cation (material 11) has 2 or more, more preferably 3 or more hydroxyl groups in one molecule thereof. When the cation (material 11) having 3 or more hydroxyl groups is used, a resin containing a polymer chain having a branched structure and having a cationic organic group in the branched structure is obtained.

The cation contains a cation skeleton and a substituent having a hydroxyl group. The cation may further have a substituent free of any hydroxyl group. The substituent having a hydroxyl group and the substituent free of any hydroxyl group are each bonded to the cation skeleton. The cation preferably has 3 or more hydroxyl groups. The reason for the foregoing is as described below. As the number of hydroxyl groups of the cation increases, the frequency at which the cation and the compound (material 12) capable of reacting with a hydroxyl group react with each other increases, and hence the ratio of the cation to be fixed to the resin increases.

[Cation Skeleton]

Examples of the cation skeleton include: noncyclic cation skeletons, such as an ammonium cation, a sulfonium cation, and a phosphonium cation; and cyclic cation skeletons, such as an imidazolium cation, a pyridinium cation, a pyrrolidinium cation, a piperidinium cation, a pyrazolium cation, a morpholinium cation, a pyrazolinium cation, a hydroimidazolium cation, a triazolium cation, a pyridazinium cation, a pyrimidinium cation, a pyrazinium cation, a triazolium cation, an oxazolium cation, an indolium cation, a quinolinium cation, an isoquinolinium cation, and a quinoxalinium cation.

[Substituent Having Hydroxyl Group]

The substituent having a hydroxyl group is bonded to the cation skeleton.

The substituent having a hydroxyl group may be such that the hydroxyl group is directly bonded to the cation skeleton like hydroxypyridinium or hydroxyimidazolium. In addition, the hydroxyl group may be bonded to the cation skeleton through a linking group including a hydrocarbon group or an alkylene ether group.

Among others, the hydroxyl group is preferably bonded to the cation skeleton through the linking group because the reactivity of the hydroxyl group is relatively high.

The linking group for bonding the hydroxyl group to the cation skeleton is, for example, a hydrocarbon group or a group containing an alkylene ether group. In addition, the substituent having a hydroxyl group is, for example, a substituent having a branched structure.

Examples of the hydrocarbon group serving as the linking group include: hydrocarbon groups each having 1 to carbon atoms, such as a methylene group, an ethylene group, a propylene group, a butylene group, a pentylene group, a hexylene group, and a phenylene group; and hydrocarbon groups each having one or more substituents free of any hydroxyl group (such as: halogen groups, such as fluorine, chlorine, bromine, and iodine; alkoxyl groups, such as a methoxy group and an ethoxy group; substituents each containing a heteroatom, such as an amide group and a cyano group; and haloalkyl groups, such as a trifluoromethyl group).

Examples of the group containing an alkylene ether group serving as the linking group include alkylene ethers each having a polymerization degree of from 1 to 10 including oligo(ethylene glycol), oligo(propylene glycol), and oligo (tetramethylene glycol).

The substituent having a branched structure is a substituent in which a plurality of hydroxyl groups are bonded to one cation skeleton through the hydrocarbon group or the group containing an alkylene ether group and whose branch point is a carbon atom or a nitrogen atom. Examples thereof include a 1,2-propanediol group, a [bis(2-hydroxyethyl) amino]ethylene group, and a 2,2-bis(hydroxymethyl)-3-hydroxypropyl group.

The cation skeleton may be substituted with a plurality of the substituents each having a hydroxyl group.

[Substituent Free of any Hydroxyl Group]

In addition to the substituent having a hydroxyl group, the cation of the ionic electroconductive agent may have one or more substituents free of any hydroxyl group (such as: hydrocarbon groups each having 1 to 30 carbon atoms; halogen groups, such as fluorine, chlorine, bromine, and iodine; alkoxyl groups, such as a methoxy group and an ethoxy group; substituents each containing a heteroatom, such as an amide group and a cyano group; and haloalkyl groups, such as a trifluoromethyl group).

Preferred examples of the ionic electroconductive agent include the following reaction products (1) and (2):

(1) a product of a reaction between at least one selected from the group consisting of a hydroxide, a methyl carbonate, an ethyl carbonate, a propyl carbonate, and a hydrogen carbonate of the cation, and a conjugate acid of the anion; and (2) a product of a reaction between at least one selected from the group consisting of a fluorosulfonate, a fluorocarboxylate, and an N-alkyl bis(fluorosulfonyl)imide, and a tertiary amine compound.

[Anion]

Examples of the anion of the ionic electroconductive agent include a fluorosulfonate anion, a fluorocarboxylate anion, a fluorosulfonylimide anion, a fluorosulfonylmethide anion, a fluoroalkylfluoroborate anion, a hexafluorophosphate anion, a hexafluoroarsenate anion, and a hexafluoroantimonate anion.

Examples of the fluorosulfonate anion include a fluorosulfonate anion, a trifluoromethanesulfonate anion, a perfluoroethylsulfonate anion, a perfluoropropylsulfonate anion, a perfluorobutylsulfonate anion, a perfluoropentylsulfonate anion, a perfluorohexylsulfonate anion, and a perfluorooctylsulfonate anion.

Examples of the fluorocarboxylate anion include a trifluoroacetate anion, a perfluoropropionate anion, a perfluorobutyrate anion, a perfluorovalerate anion, and a perfluorocaproate anion.

Examples of the fluorosulfonylimide anion include a trifluoromethanesulfonylimide anion, a perfluoroethylsulfonylimide anion, a perfluoropropylsulfonylimide anion, a perfluorobutylsulfonylimide anion, a perfluoropentylsulfonylimide anion, a perfluorohexylsulfonylimide anion, a perfluorooctylsulfonylimide anion, a fluorosulfonylimide anion, and a cyclic anion such as cyclo-hexafluoropropane-1,3-bis(sulfonyl)imide.

Examples of the fluorosulfonylmethide anion include a trifluoromethanesulfonylmethide anion, a perfluoroethylsulfonylmethide anion, a perfluoropropylsulfonylmethide anion, a perfluorobutylsulfonylmethide anion, a perfluoropentylsulfonylmethide anion, a perfluorohexylsulfonylmethide anion, and a perfluorooctylsulfonylmethide anion.

Examples of the fluoroalkylfluoroborate anion include a trifluoromethyltrifluoroborate anion and a perfluoroethyltrifluoroborate anion.

The blending amount of the ionic electroconductive agent is preferably 0.01 part by mass or more and 20 parts by mass or less in 100 parts by mass of the electroconductive layer. When the blending amount is 0.01 part by mass or more, an electroconductive layer having high electroconductivity is obtained. When the blending amount is 20 parts by mass or less, an electroconductive layer in which the bleeding of the ionic electroconductive agent is suppressed is obtained.

<Compound Capable of Reacting with Hydroxyl Group>

Examples of the "material 12" serving as the "compound capable of reacting with a hydroxyl group" include an isocyanate compound having an isocyanate group, an epoxide compound having a glycidyl group, and a melamine resin compound having an alkoxyl group, an imino group, and a methylol group.

Examples of the isocyanate compound include: aliphatic polyisocyanates, such as ethylene diisocyante and 1,6-hexamethylene diisocyante (HDI); alicyclic polyisocyanates, such as isophorone diisocyanate (IPDI), cyclohexane 1,3-diisocyanate, and cyclohexane 1,4-diisocyanate; aromatic isocyanates, such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, and naphthalene diisocyanate; and copolymers thereof, isocyanurates thereof, TMP adducts thereof, biuret compounds thereof, and blocked compounds thereof.

Examples of the epoxide compound include: an aliphatic diepoxide, such as 1,4-butanediol diglycidyl ether; and an aromatic diepoxide, such as bisphenol A diglycidyl ether. Examples of the melamine compound include a methylated melamine, a butylated melamine, an imino-type melamine, a methylated/butylated melamine, and a methylol-type melamine.

Of those, the following compound is preferred: an aromatic isocyanate such as tolylene diisocyanate, diphenylmethane diisocyanate, or polymeric diphenylmethane diisocyanate; or a melamine compound such as a methylated melamine, a butylated melamine, an imino-type melamine, a methylated/butylated melamine, or a methylol-type melamine.

Each of those compounds has high reactivity with the hydroxyl group of the cation and reduces the ratio of the cation that is not bonded to the resin, and hence an electroconductive layer in which the bleeding of the ionic electroconductive agent is suppressed is obtained.

Next, the "amine compound" and "anion precursor" to be used in the synthesis of the resin according to the method (J-2) are described.

<Amine Compound>

The amine compound is a compound having 3 or more nitrogen atoms of a tertiary amine. One or more each of reactive functional groups and nonreactive functional groups may be bonded to a structure having a nitrogen atom. In addition, the amine compound may be a polymer compound containing one kind or two or more kinds of monomer units each having a nitrogen atom.

Examples of the structure having a nitrogen atom include: aliphatic amines, such as a monoalkylamine, a dialkylamine, and a trialkylamine; aromatic amines, such as diphenylamine and triphenylamine; alicyclic amines, such as piperidine and pyrrolidine; and nitrogen-containing heteroaromatic rings, such as imidazole and pyridine.

Examples of the reactive functional group include a hydroxyl group, a thiol group, a vinyl group, an epoxy group, a (meth)acrylic group, and an isocyanate group. The reactive functional group may be directly bonded to the structure having a nitrogen atom, or may be bonded to the structure having a nitrogen atom through a hydrocarbon group having 1 to 30 carbon atoms, such as a methylene group, an ethylene group, a propylene group, a butylene group, a pentylene group, a hexylene group, or a phenylene group.

Examples of the nonreactive functional group include: hydrocarbon groups each having 1 to 30 carbon atoms; halogen groups, such as fluorine, chlorine, bromine, and iodine; alkoxyl groups, such as a methoxy group and an ethoxy group; substituents each containing a heteroatom, such as an amide group and a cyano group; and haloalkyl groups including a trifluoromethyl group.

The polymer compound containing one kind or two or more kinds of monomer units each having a nitrogen atom needs only to be such that a monomer having a nitrogen atom is polymerized at a polymerization degree of at least 10. The monomer having a nitrogen atom is such that a functional group containing a double bond is bonded to a structure having a nitrogen atom. Examples of the structure having a nitrogen atom include: aliphatic amines, such as a monoalkylamine, a dialkylamine, and a trialkylamine; aromatic amines, such as diphenylamine and triphenylamine; alicyclic amines, such as piperidine and pyrrolidine; and nitrogen-containing heteroaromatic rings, such as imidazole and pyridine. Examples of the functional group containing a double bond include a vinyl group, an allyl group, an acrylic group, and a methacrylic group.

Specific examples of the amine compound include diethylenetriamine, triethylenetetramine, tris(2-aminoethyl)amine, tris(2-pyridylmethyl)amine, 1,1,4,7,10,10-hexamethyltriethylenetetramine, N,N,N',N",N"-pentamethyldiethylenetriamine, tris[2-(dimethylamino)ethyl]amine, and tris[2-(methylamino)ethyl]amine. Examples of the polymer compound containing one kind or two or more kinds of monomer units each having a nitrogen atom include poly(l-vinylimidazole), poly(2-vinylpyridine), poly(4-vinylpyridine), poly(diethylaminoethyl acrylate), poly(dimethylaminoethyl acrylate), poly(diethylaminoethyl methacrylate), and poly(dimethylaminoethyl methacrylate). Of those, at least one compound selected from the group consisting of poly(l-vinyl imidazole), poly(4-vinylpyridine), and poly(dimethylaminoethyl methacrylate) may be suitably used.

<Anion Precursor>

The anion precursor is, for example, a compound having a plurality of substituents A each represented by the following chemical formula (5-1) or (5-2), and containing a saturated hydrocarbon, an unsaturated hydrocarbon, or an aromatic hydrocarbon.

$$—N(SO_2R^1)_2 \text{ or} \qquad \text{Chemical formula (5-1)}$$

$$—OSO_2R^2 \qquad \text{Chemical formula (5-2)}$$

In the chemical formulae (5-1) and (5-2), $R^1$ and $R^2$ each independently represent a fluorine atom or a perfluoroalkyl group having 1 to 5 carbon atoms.

Examples of the saturated hydrocarbon incorporated into the anion precursor include an alkane and a cycloalkane. Examples of the unsaturated hydrocarbon include an alkene, a cycloalkene, an alkyne, and a cycloalkyne. Examples of the aromatic hydrocarbon include benzene, biphenyl, naphthalene, and anthracene. One or more nonreactive functional groups may be bonded to the saturated hydrocarbon, the unsaturated hydrocarbon, or the aromatic hydrocarbon. Examples of the nonreactive functional group include: hydrocarbon groups each having 1 to 30 carbon atoms; halogen groups, such as fluorine, chlorine, bromine, and iodine; alkoxyl groups, such as a methoxy group and an ethoxy group; substituents each containing a heteroatom, such as an amide group and a cyano group; and haloalkyl groups including a trifluoromethyl group.

The anion precursor is, for example, a compound having, in a molecule thereof, 2 or more groups of at least one kind selected from $—N(SO_2R^1)_2$ and $—OSO_2R^2$.

It should be noted that $R^1$ and $R^2$ each independently represent a fluorine atom or a perfluoroalkyl group having 1 to 5 carbon atoms.

More specific examples thereof include compounds represented by the following chemical formulae (1) to (4).

In the present invention, at least one selected from the group of compounds represented by the following chemical formulae (1) to (4) can be used as the anion precursor.

$$A1—(CRaRb)m_1—A2 \qquad \text{Chemical formula (1)}$$

$$A3—(CH_2)m_2—C_6H_4—(CH_2)m_3—A4 \qquad \text{Chemical formula (2)}$$

$$H_{3-X}—N\left[(CH_2)m_4—A5\right]_X \qquad \text{Chemical formula (3)}$$

$$Rc\left[O—(CH_2)m_5—A6\right]_Y \qquad \text{Chemical formula (4)}$$

In the chemical formulae (1) to (4), A1 to A6 each independently represent $—N(SO_2R^1)_2$ or $—OSO_2R^2$, Ra, Rb, and Rc each independently represent a hydrogen atom or an alkyl group that may have a substituent, $m_1$ represents an integer of from 1 to 30, $m_2$ to $m_5$ each independently represent an integer of from 1 to 15, X represents 2 or 3, and when Rc represents a hydrogen atom, Y represents 1, and when Rc represents an alkyl group that may have a substituent, Y represents an integer of from 2 to 10. $R^1$ and $R^2$ each independently represent a fluorine atom or a perfluoroalkyl group having 1 to 5 carbon atoms.

In addition, the compound represented by the chemical formula (1) is particularly suitably used in the present invention. Of those, N,N,N',N'-tetra(trifluoromethanesulfonyl)-hexane-1,6-diamine or N,N,N',N'-tetra(trifluoromethanesulfonyl)-dodecane-1,12-diamine is particularly suitably used.

The anion precursor is added to a paint for forming an electroconductive layer together with the amine compound. Upon formation of the resin of the electroconductive layer on the substrate, the anion precursor reacts with the amine compound to produce an onium salt compound. At this time, the amine compound has a structure having 3 or more nitrogen atoms in one molecule thereof, and hence 3 or more molecules of the anion precursor are bonded to one molecule of the amine compound. Accordingly, a three-dimensional crosslinked structure is formed and hence the anion precursor is fixed in the electroconductive layer. An example of the reaction at this time is represented by the following reaction formula (6). In this case, poly(4-vinylpyridine) corresponds to the amine compound, and N,N,N',N'-tetra(trifluoromethanesulfonyl)-dodecane-1,12-diamine corresponds to the anion precursor. In the reaction formula (6), TFSA represents $N(SO_2CF_3)_2$.

(6)

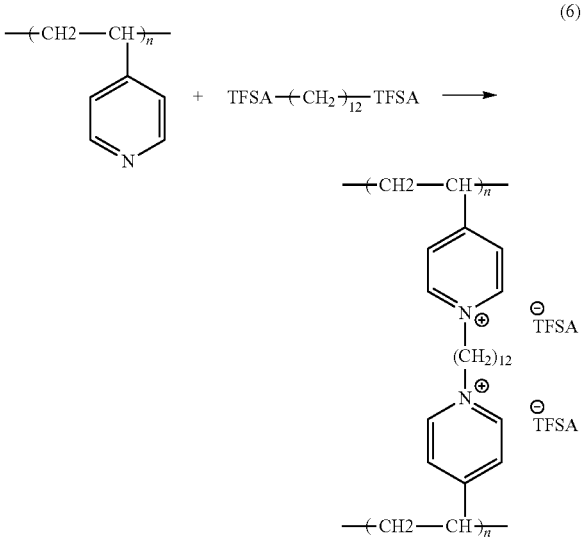

<Anion in Electroconductive Layer>

Examples of the anion in the electroconductive layer include the anion of the ionic electroconductive agent and the anion of the anion precursor. Examples of the anion of the ionic electroconductive agent include a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion.

<Alkali Metal and Alkali Earth Metal>

In the present invention, the alkali metal refers to lithium, sodium, potassium, rubidium, cesium, or francium. In addition, the alkali earth metal refers to magnesium, calcium, strontium, barium, or radium.

Causes for the inclusion of any such metal in the electroconductive layer are as follows: the case where the foregoing metals are originally included as impurities in resin raw materials for the electroconductive layer (the ionic electroconductive agent, the amine compound, the anion precursor, a compound capable of reacting with a cation, and a polyol); and the case where the metals are included in a production process upon formation of the electroconductive layer.

A method involving removing a metal in the ionic electroconductive agent out of the resin raw materials listed above is preferred because the effects of the present invention are obtained efficiently and to the fullest extent.

The alkali metal and the alkali earth metal (hereinafter sometimes referred to as "alkali (earth) metals") in the ionic electroconductive agent are included from raw materials upon synthesis of the ionic electroconductive agent in many cases.

In other words, a method involving obtaining the target ionic electroconductive agent through an exchange reaction between an ionic compound having the target cation and a halogen ion including a chloride ion, and a salt of the target anion and an alkali (earth) metal is frequently used. In this case, however, the alkali (earth) metal serving as a raw material is liable to be included in the ionic electroconductive agent. Washing or an ion exchange resin can be used for removing the included alkali (earth) metal, but such method is not economical because the yield of the ionic electroconductive agent reduces. Accordingly, instead of the removal of the alkali (earth) metal after the synthesis of the ionic electroconductive agent, a method of synthesizing the ionic electroconductive agent is preferably changed to prevent the metal from being included.

Examples of such method of synthesizing the ionic electroconductive agent include the following three reactions (I-1), (I-2), and (I-3):

(I-1) a reaction between a compound having the target cation and a hydroxide anion, and an acid compound having the target anion and a proton;

(I-2) a reaction between a tertiary amine compound and an ester compound of the target anion (such as a perfluoroalkyl sulfonate) or an imidized product of the target anion (such as an N-alkylbis(fluorosulfonyl)imide); and (I-3) a reaction between an alkyl carbonate or hydrogen carbonate of the target cation, and an acid compound having the target anion and a proton.

The methods of synthesizing the ionic electroconductive agent according to the (I-1) to (I-3) are excellent because a high-purity ionic electroconductive agent is obtained more efficiently by each of the methods than by a salt exchange reaction involving using an alkali metal salt.

A specific example of the method of synthesizing the ionic electroconductive agent according to the (I-1) is a method involving causing a compound having a cation having 2 or more hydroxyl groups and a hydroxide anion to react with a compound having at least one anion selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion and a proton.

Herein, an example of the compound having a cation having 2 or more hydroxyl groups and a hydroxide anion is at least one selected from the group consisting of tris (hydroxyethyl)methylammonium hydroxide, and bis(hydroxyethyl)dimethylammonium hydroxide.

Of those, tris(hydroxyethyl)methylammonium hydroxide, which has 3 hydroxyl groups and allows provision of a resin having a branched structure, is particularly suitably used.

In addition, an example of the compound having at least one anion selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion and a proton is at least one selected from bis(trifluoromethanesulfonyl)amide, bis(nonafluorobutanesulfonyl)amide, 4,4,5,5,6,6-hexafluorodihydro-4H-1,3,2-dithiazine 1,1,3,3-tetraoxide, trifluoromethanesulfonic acid, nonafluorobutanesulfonic acid, trifluoroacetic acid, heptafluorobutyric acid, tris(trifluoromethanesulfonyl)methide, and trifluoromethyltrifluoroboronic acid.

A specific example of the method of preparing the ionic electroconductive agent according to the (I-2) is a method of causing a tertiary amine compound to react with an imidized product of at least one anion selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion.

Another specific example thereof is a method of causing a tertiary amine compound to react with an ester compound of at least one anion selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion.

A specific example of the tertiary amine compound in this case is at least one selected from N-methyldiethanolamine, triethanolamine, 2-pyridineethanol, 1-hydroxyethyl-2-hydroxymethylimidazole, N-hydroxyethylpyrrolidone, and N-hydroxyethylpiperidine.

In addition, a specific example of the imidized product of at least one anion selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion is at least one selected from N-methyl bis(trifluoromethylsulfonyl)imide, and N-hydroxyethyl bis(trifluoromethylsulfonyl)imide.

It should be noted that the alkali (earth) metal may be included in the production process for the electroconductive layer as well. In other words, when glass beads are used as media upon mixing and dispersion of the resin raw materials for forming the electroconductive layer, the alkali (earth) metal is liable to be included in the electroconductive layer. Accordingly, beads each made of zirconia are preferably used as dispersion media. In addition, a method involving washing, after the formation of the electroconductive layer or after the production of the member for electrophotography, the layer or the member with a solvent, such as water or methanol, is effective in reducing the content of the alkali (earth) metal.

The total sum of the contents of the alkali metal and the alkali earth metal in the electroconductive layer of the present invention is 500 ppm or less. A more preferred range of the content for obtaining the effects of the present invention is 100 ppm or less.

The content of a metal in the electroconductive layer can be examined as described below. First, the electroconductive layer is asked by heating, the ash is dissolved in nitric acid and hydrofluoric acid by heating, and the solution is dried and hardened. After that, the hardened product is dissolved in dilute nitric acid so that a constant volume may be obtained. The resultant constant-volume liquid is subjected to inductively coupled plasma-atomic emission spectroscopy (hereinafter "ICP-AES analysis") or inductively coupled plasma-mass spectroscopy (ICP-MS analysis), and the content of the target metal is determined from an emission intensity determined from a calibration curve obtained by using a solution having a known concentration.

<Resin>

Examples of the "resin" of the "resin having a cationic organic group in a molecule thereof" in the electroconductive layer include an isocyanate resin, an epoxy resin, and a melamine resin that are derived from the "material 12" serving as the "compound capable of reacting with a hydroxyl group." In addition, the "resin" is, for example, a polymer compound containing one kind or two or more kinds of monomer units each having a nitrogen atom, the units constituting the "amine compound."

The "resin" in the electroconductive layer may contain a resin synthesized from the "material 12" serving as the "compound capable of reacting with a hydroxyl group" and a polyol. The polyol has a plurality of hydroxyl groups in a molecule thereof, and the hydroxyl groups each react with the "compound capable of reacting with a hydroxyl group." Examples of the polyol include, but not particularly limited to, polyether polyol and polyester polyol. Examples of the polyether polyol include polyethylene glycol, polypropylene glycol, and polytetramethylene glycol. In addition, an example of the polyester polyol is polyester polyol obtained by a condensation reaction between a diol component, such as 1,4-butanediol, 3-methyl-1,4-pentanediol, or neopentyl glycol, or a triol component, such as trimethylolpropane, and a dicarboxylic acid including adipic acid, phthalic anhydride, terephthalic acid, or hexahydroxyphthalic acid. As required, the polyether polyol and the polyester polyol may each be used as a prepolymer obtained through chain extension with an isocyanate, such as 2,4-tolylene diisocyanate (TDI), 1,4-diphenylmethane diisocyanate (MDI), or isophorone diisocyanate (IPDI), in advance.

It is preferred that the "resin" in the electroconductive layer contain a polymer chain having a branched structure and the cationic organic group be present in the branched structure of the polymer chain.

When the cationic organic group is present in the branched structure of the polymer chain, the mobility of the cationic organic reduces. Since the anion electrostatically interacts with the cationic organic group, the anion is captured by the cationic organic group whose mobility is reduced. Therefore, the cation is difficult to migrate to the surface of the electroconductive layer.

<Other Resin>

A general resin, rubber material, blending agent, electroconductivity-imparting agent, non-electroconductive filler, crosslinking agent, or catalyst other than the resins according to the present invention may be added to the electroconductive layer as required to such an extent that the effects of the present invention are not impaired. Examples of the resin to be added include, but not particularly limited to, an epoxy resin, a urethane resin, a urea resin, an ester resin, an amide resin, an imide resin, an amide imide resin, a phenol resin, a vinyl resin, a silicone resin, and a fluororesin. Examples of the rubber material include an ethylene-propylene-diene copolymerized rubber, an acrylonitrile-butadiene rubber, a chloroprene rubber, a natural rubber, an isoprene rubber, a styrene-butadiene rubber, a silicone rubber, an epichlorohydrin rubber, and a urethane rubber. Examples of the blending agent include a filler, a softening agent, a processing aid, a tackifier, an anti-adhesion agent, and a foaming agent generally used in a resin. Available as the electroconductivity-imparting agent is carbon black, an electroconductive metal, such as aluminum or copper, or a fine particle of an electroconductive metal oxide, such as electroconductive zinc oxide, electroconductive tin oxide, or electroconductive titanium oxide. Examples of the non-electroconductive filler include silica, quartz powder, titanium oxide, and calcium carbonate. Examples of the crosslinking agent include, but not particularly limited to, tetraethoxysilane, di-t-butyl peroxide, 2,5-dimethyl-2,5-di(t-butylperoxy)hexane, and dicumyl peroxide.

<Roughness-Controlling Fine Particles>

When the electroconductive layer according to the present invention is applied to the surface layer of a member for electrophotography and the surface layer is required to have a surface roughness, fine particles for roughness control may be added to the electroconductive layer. In particular, when the electroconductive layer is used in the surface layer of a developing roller, the volume-average particle diameter of the roughness-controlling fine particles is preferably from 3 μm to 20 μm because a developing roller excellent in ability to convey a developer is obtained. In addition, the addition amount of the fine particles to be added to the electroconductive layer is preferably from 1 part by mass to 50 parts by mass with respect to 100 parts by mass of the resin solid content of the electroconductive layer in order to prevent the effects of the present invention from being impaired. Fine particles of a polyurethane resin, a polyester resin, a polyether resin, a polyamide resin, an acrylic resin, or a phenol resin can be used as the roughness-controlling fine particles.

<Method of Producing Member for Electrophotography>

A method of producing a member for electrophotography includes the steps of:

(1) forming, on an electroconductive substrate, a coating film of a paint for forming the electroconductive layer according to the present invention; and (2) causing reactive components in the coating film to react with each other to form the electroconductive layer.

The method of producing a member for electrophotography is described below for each of the cases where the resin production methods (J-1) and (J-2) are used.

Case where Resin Production Method (J-1) is Used;

In the step (1), a coating film of a paint containing a cation having 2 or more hydroxyl groups and a compound capable of reacting with a hydroxyl group is formed on the electroconductive substrate.

In the step (2), the electroconductive layer is formed by causing the cation having 2 or more hydroxyl groups and the compound capable of reacting with a hydroxyl group in the coating film to react with each other.

The method may include the step of preparing an ionic electroconductive agent having the cation having 2 or more hydroxyl groups and at least one anion selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion prior to the step (1).

An example of the step of preparing the ionic electroconductive agent includes the step of causing a compound having the cation having 2 or more hydroxyl groups and a hydroxide anion, and a compound having the anion and a proton to react with each other.

In this case, a cation having 3 or more hydroxyl groups is more preferably used as the cation.

An example of the compound having the cation having 2 or more hydroxyl groups and a hydroxide anion is at least one selected from tris(hydroxyethyl)methylammonium hydroxide, bis(hydroxyethyl)dimethylammonium hydroxide, and 2-hydroxyethyltrimethylammonium hydroxide.

In addition, an example of the compound having the anion and a proton is at least one selected from bis(trifluoromethanesulfonyl)amide, bis(nonafluorobutanesulfonyl)amide, 4,4,5,5,6,6-hexafluorodihydro-4H-1,3,2-dithiazine 1,1,3,3-tetraoxide, trifluoromethanesulfonic acid, nonafluorobutanesulfonic acid, trifluoroacetic acid, heptafluorobutyric acid, tris(trifluoromethanesulfonyl)methide, and trifluoromethyltrifluoroboronic acid.

In addition, the step of preparing the ionic electroconductive agent can include the step of causing a tertiary amine compound to react with an imidized product or ester compound of at least one anion selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion.

In this case, an example of the tertiary amine compound is at least one selected from N-methyldiethanolamine, triethanolamine, 2-pyridineethanol, 1-hydroxyethyl-2-hydroxymethylimidazole, N-hydroxyethylpyrrolidone, and N-hydroxyethylpiperidine.

In addition, an example of the imide compound of the anion is at least one selected from N-methyl bis(trifluoromethylsulfonyl)imide, N-hydroxyethyl bis(trifluoromethylsulfonyl)imide, and 2-hydroxyethyltrifluoromethanesulfonate.

The step of preparing the ionic electroconductive agent can include the step of causing an alkyl carbonate or hydrogen carbonate of the cation having 2 or more hydroxyl groups, and the compound having the anion and a proton to react with each other.

Case where Resin Production Method (J-2) is Used;

In the step (1), a coating film of a paint containing a compound having 3 or more nitrogen atoms of a tertiary amine, and a compound having, in a molecule thereof, 2 or more groups of at least one of kinds represented by $—N(SO_2R^1)_2$ and $—OSO_2R^2$ (where $R^1$ and $R^2$ each independently represent a fluorine atom or a perfluoroalkyl group having to 5 carbon atoms) is formed on the electroconductive substrate.

In the step (2), the electroconductive layer is formed by causing the compound having 3 or more nitrogen atoms of a tertiary amine, and the compound having, in a molecule thereof, 2 or more groups of at least one of kinds represented by $—N(SO_2R^1)_2$ and $—OSO_2R^2$ (where $R^1$ and $R^2$ each independently represent a fluorine atom or a perfluoroalkyl group having 1 to 5 carbon atoms) in the coating film to react with each other.

An example of the compound having 3 or more nitrogen atoms of a tertiary amine in this method is at least one selected from the group consisting of poly(1-vinyl imidazole), poly(4-vinylpyridine), and poly(dimethylaminoethyl methacrylate).

In addition, an example of the compound having, in a molecule thereof, 2 or more groups of at least one of kinds represented by $—N(SO_2R^1)_2$ and $—OSO_2R^2$ is at least one selected from the group of compounds represented by the following chemical formulae (1) to (4).

Chemical formula (1)

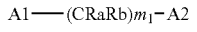

Chemical formula (2)

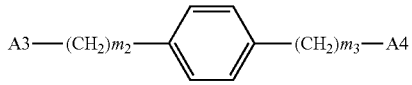

Chemical formula (3)

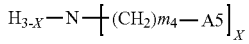

Chemical formula (4)

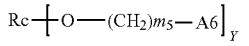

In the chemical formulae (1) to (4), A1 to A6 each independently represent $—N(SO_2R^1)_2$ or $—OSO_2R^2$, Ra, Rb, and Rc each independently represent a hydrogen atom or an alkyl group that may have a substituent, $m_1$ represents an integer of from 1 to 30, $m_2$ to $m_5$ each independently represent an integer of from 1 to 15, X represents 2 or 3, when Rc represents a hydrogen atom, Y represents 1, and when Rc represents an alkyl group that may have a substituent, Y represents an integer of from 2 to 10, and $R^1$ and $R^2$ each independently represent a fluorine atom or a perfluoroalkyl group having 1 to 5 carbon atoms.

Of the group of compounds having structures represented by the chemical formulae (1) to (4), a compound having a structure represented by the chemical formula (1) is particularly suitably used.

Specific examples thereof include N,N,N',N'-tetra(trifluoromethanesulfonyl)-hexane-1,6-diamine and N,N,N',N'-tetra(trifluoromethanesulfonyl)-dodecane-1,12-diamine.

A method of forming the coating film of a paint on the electroconductive substrate is not particularly limited. Examples thereof include spraying with a paint, dipping, and roll coating. Such dip coating method involving causing a paint to overflow from the upper end of a dipping tank as described in Japanese Patent Application Laid-Open No. S57-5047 is simple and excellent in production stability as the method of forming the electroconductive layer.

In addition, a method known in the field of a member for electrophotography can be used as a method of forming the electroconductive layer according to the present invention upon application of the electroconductive layer to the elastic layer 13 illustrated in FIG. 1A. Examples thereof include: a method involving coextruding the substrate and the materials for the electroconductive layer to mold the layer; and a method involving, when the materials for forming the electroconductive layer are liquid, injecting the materials into a mold having arranged therein a cylindrical pipe, pieces arranged on both ends of the pipe for holding the substrate, and the substrate, and heating and curing the materials.

The member for electrophotography is applicable to a member for electrophotography, such as a charging roller, a developing roller, a developing blade, a transfer roller, or a cleaning blade. When the member for electrophotography is applied to a developing roller in a developing apparatus, a developer may be magnetic or nonmagnetic, and may be a one-component developer or a two-component developer. The developing apparatus may be of a noncontact type or a contact type.

[Process Cartridge and Electrophotographic Apparatus]

Figure 2:
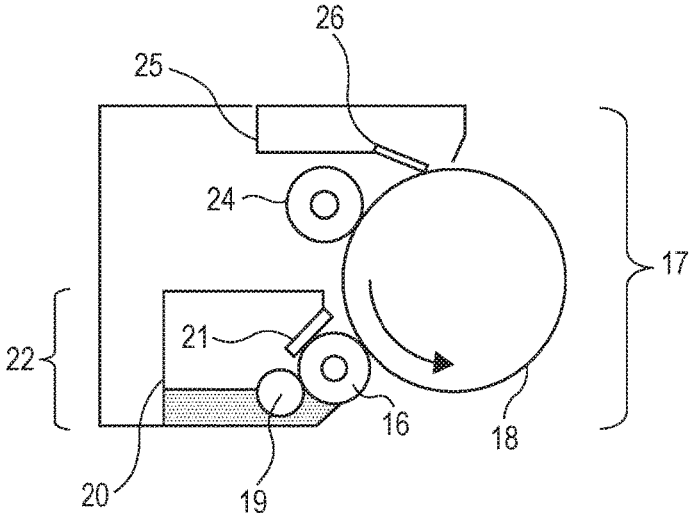
FIG. 2 is a schematic construction view for illustrating an example of a process cartridge according to the present invention.

FIG. 2 is a sectional view of the process cartridge according to the present invention. A process cartridge 17 illustrated in FIG. 2 is obtained by integrating a developing roller 16, a developing blade 21, a photosensitive member 18, a cleaning blade 26, a waste toner-storing container 25, and a charging roller 24. In addition, the process cartridge is removably mounted onto the main body of an electrophotographic apparatus. A developing apparatus 22 includes a toner container 20 and toner is loaded into the toner container 20. The toner in the toner container 20 is supplied to the surface of the developing roller 16 by a toner-supplying roller 19, and a layer of the toner having a predetermined thickness is formed on the surface of the developing roller 16 by the developing blade 21.

Figure 3:
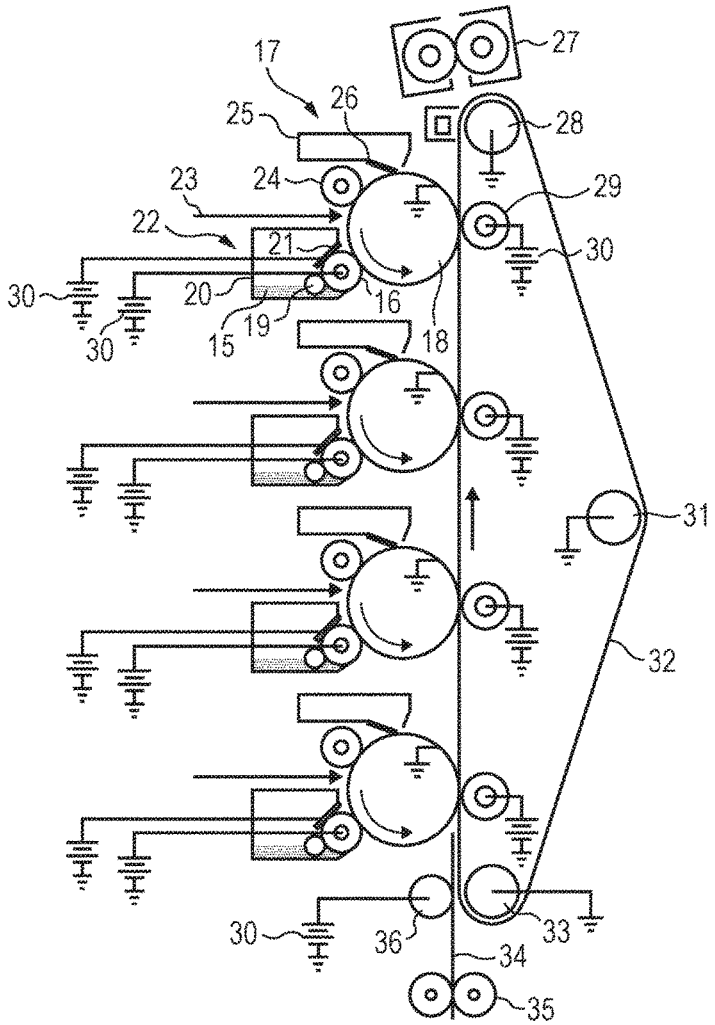
FIG. 3 is a schematic construction view for illustrating an example of an electrophotographic apparatus according to the present invention.

FIG. 3 is a sectional view of an electrophotographic apparatus in which the member for electrophotography according to the present invention is used as the developing roller 16. Removably mounted onto the electrophotographic apparatus of FIG. 3 is the developing apparatus 22 including the developing roller 16, the toner-supplying roller 19, the toner container 20, and the developing blade 21. Also removably mounted thereonto is the process cartridge 17 including the photosensitive member 18, the cleaning blade 26, the waste toner-storing container 25, and the charging roller 24. In addition, the photosensitive member 18, the cleaning blade 26, the waste toner-storing container 25, and the charging roller 24 may be provided in the main body of the electrophotographic apparatus. The photosensitive member 18 rotates in a direction indicated by the arrow, and is uniformly charged by the charging member 24 for subjecting the photosensitive member 18 to charging treatment, and an electrostatic latent image is formed on the surface by laser light 23 as an exposing unit for writing the electrostatic latent image on the photosensitive member 18. The toner is applied to the electrostatic latent image by the developing apparatus 22, which is placed so as to be brought into contact with the photosensitive member 18, to develop the image, whereby the image is visualized as a toner image.

The development performed here is the so-called reversal development in which the toner image is formed in an exposure portion. The visualized toner image on the photosensitive member 18 is transferred onto paper 34 serving as a recording medium by a transfer roller 29 serving as a transfer member. The paper 34 is fed into the apparatus through a sheet-feeding roller 35 and an adsorption roller 36, and is conveyed to a gap between the photosensitive member 18 and the transfer roller 29 by an endless belt-shaped transfer conveyance belt 32. The transfer conveyance belt 32 is operated by a driven roller 33, a driver roller 28, and a tension roller 31. A voltage is applied from a bias power source 30 to each of the transfer roller 29 and the adsorption roller 36. The paper onto which the toner image has been transferred is subjected to a fixation treatment by a fixing apparatus 27 and discharged to the outside of the apparatus. Thus, a printing operation is completed.

Meanwhile, toner remaining on the photosensitive member 18 without being transferred onto the paper 34 is scraped off by the cleaning blade 26, and is stored in the waste toner-storing container 25.

The developing apparatus 22 includes: the toner container 20 storing the toner as a one-component developer; and the developing roller 16 as a developer carrier that is positioned in an opening portion extending in a lengthwise direction in the toner container 20 and is placed so as to face the photosensitive member 18. The developing apparatus 22 is configured to develop and visualize the electrostatic latent image on the photosensitive member 18.

According to one mode of the present invention, a resin having a specific structure is arranged in an electroconductive layer and the content of a specific metal component is reduced, and hence a member for electrophotography that can maintain charge-providing performance at a high level even after having been left to stand under a high-temperature and high-humidity environment for a long time period, and is hence conducive to the formation of a high-quality electrophotographic image can be obtained.

In addition, according to another mode of the present invention, a process cartridge and an electrophotographic apparatus that can stably form high-quality electrophotographic images can be obtained.

EXAMPLES

Specific Examples and Comparative Examples in each of which the electroconductive layer according to the present invention is applied to the surface layer 14 of the member for electrophotography as illustrated in FIG. 1B are described below. However, the present invention is not limited to these Examples.

Prior to Examples, the following production examples are sequentially described:

1. Production Examples of Elastic Rollers and Supporting Substrate;
2. Production Examples of Anion Precursors;
3. Production Examples of Imidazoles;
4. Production Examples of Ionic Electroconductive Agents;
5. Production Examples of Isocyanate Group-terminated Prepolymers; and
6. Production Examples of Paints.

[1. Production Examples of Elastic Rollers and Supporting Substrate]

(Production of Elastic Roller D-1)

A primer (trade name: DY35-051; manufactured by Dow Corning Toray Co., Ltd.) was applied to a cored bar made of stainless steel (SUS304) having a diameter of 6 mm and a total length of 278.9 mm, and was baked thereto with an oven heated to a temperature of 180° C. for 20 minutes. Thus, a substrate was obtained. The substrate was placed in a mold, and an addition-type silicone rubber composition obtained by mixing materials shown in Table 1 below was injected into a cavity formed in the mold.

TABLE 1

| Material | Part(s) by mass |
|---|---|
| Liquid silicone rubber material (trade name: SE6724A/B; manufactured by Dow Corning Toray Co., Ltd.) | 100 |
| Carbon black (trade name: TOKABLACK #4300; manufactured by Tokai Carbon Co., Ltd.) | 15 |
| Silica powder serving as a heat resistance-imparting agent | 0.2 |
| Platinum catalyst | 0.1 |

Subsequently, the mold was heated to 150° C. for 15 minutes to vulcanize and cure the silicone rubber. The substrate having formed on its peripheral surface the cured silicone rubber layer was removed from the mold, and then the curing reaction of the silicone rubber layer was completed by further heating the substrate at a temperature of 180° C. for 1 hour. Thus, an elastic roller D-1 in which a silicone rubber elastic layer having a diameter of 12 mm was formed on the outer periphery of the substrate was produced.

(Production of Elastic Roller D-2)

A round bar having a total length of 252 mm and an outer diameter of 6 mm was prepared by subjecting the surface of free-cutting steel to an electroless nickel plating treatment. A substrate was obtained by applying an adhesive over the whole periphery of a portion of the round bar having a length of 230 mm excluding both of its end portions each having a length of 11 mm. An electroconductive and hot melt-type adhesive was used as the adhesive. In addition, a roll coater was used in the application.

Next, respective materials whose kinds and amounts were shown in the column "Component 1" of Table 2 below were mixed by using a pressure kneader to provide an A-kneaded rubber composition 1. Further, the A-kneaded rubber composition 1 was mixed with respective materials whose kinds and amounts were shown in the column "Component 2" of Table 2 by using an open roll to prepare an unvulcanized rubber composition.

TABLE 2

| | Material | Part(s) by mass |
|---|---|---|
| Component 1 | NBR rubber (trade name: Nipol DN219; manufactured by Zeon Corporation) | 100 |
| | Carbon black (trade name: TOKABLACK #4300; manufactured by Tokai Carbon Co., Ltd.) | 40 |
| | Calcium carbonate (trade name: NANOX #30; manufactured by Maruo Calcium Co., Ltd.) | 20 |
| | Stearic acid (trade name: Stearic Acid S; manufactured by Kao Corporation) | 1 |
| Component 2 | Sulfur (trade name: Sulfax 200S; manufactured by Tsurumi Chemical Industry Co., Ltd.) | 1.2 |
| | Tetrabenzylthiuram disulfide (trade name: TBZTD; manufactured by Sanshin Chemical Industry Co., Ltd.) | 4.5 |

Next, a die having an inner diameter of 16.5 mm was mounted to a crosshead extruder having a mechanism for supplying a substrate and a mechanism for discharging an unvulcanized rubber roller, the temperatures of the extruder and the die (crosshead) were adjusted to 80° C., and the speed at which an electroconductive substrate was conveyed was adjusted to 60 mm/sec. Under the foregoing conditions, the unvulcanized rubber composition was supplied from the extruder and the outer peripheral portion of the electroconductive substrate was covered with the unvulcanized rubber composition as an elastic layer in the crosshead. Next, the resultant was loaded into a hot-air vulcanizing furnace at 170° C. and heated for 60 minutes. After the resultant had been cooled, the end portions of the elastic layer were cut and removed, and the surface of the elastic layer was polished with a rotary grinding stone. Thus, an elastic roller D-2 having a diameter at each of positions distant from a central portion in its axial direction toward both of its end portions by 90 mm each of 8.4 mm, and having a diameter at the central portion of 8.5 mm was produced.

(Production of Supporting Substrate D-3)

A SUS sheet having a thickness of 0.08 mm (manufactured by Nisshin Steel Co., Ltd.) was press-cut into dimensions of 200 mm long by 23 mm wide to produce a supporting substrate D-3.

[Preparation of Surface Layer]

Synthesis examples for obtaining a surface layer of the present invention are described below.

[2. Production Examples of Anion Precursors]

Synthesis of Anion Precursor E-1
(N-hydroxyethylbis(trifluoromethanesulfonyl)imide)

An atmosphere in a round bottom flask having placed therein a stirrer was replaced with nitrogen, and 3 g of 2-aminoethanol (49 mmol, manufactured by Tokyo Chemical Industry Co., Ltd.) and 12.7 g of diisopropylethylamine (98 mmol, manufactured by Tokyo Chemical Industry Co., Ltd.) dissolved in 500 ml of anhydrous dichloromethane were loaded into the flask. Next, the flask was placed in a dry ice/methanol bath and the solution was cooled to −78° C. 20.6 Milliliters of trifluoromethanesulfonic anhydride (123 mmol, manufactured by Tokyo Chemical Industry Co., Ltd.) was dropped to the solution with a syringe. The temperature of the reaction solution was returned to room temperature over 1 hour, and the reaction solution was further stirred for 1 hour at room temperature. After that, dilute hydrochloric acid (3%) was added to the reaction solution, and the mixture was subjected to a liquid separation with dichloromethane and water. An organic layer was recovered, dehydrated with magnesium sulfate, and filtered. The solvent was distilled off under reduced pressure. Thus, a crude product was obtained. The crude product was dissolved in 200 ml of pentane in a flask, a Dimroth condenser was mounted to the flask, and the pentane solution was refluxed for 2 hours. After the 2 hours of reflux, the pentane solution was recovered and pentane was distilled off under reduced pressure. The remaining solid was dried to provide 13 g of an anion precursor E-1 (N-hydroxyethylbis(trifluoromethanesulfonyl)imide) as a pale brown solid (40.8 mmol, 83% yield).

The structure of the anion precursor E-1 is represented by the chemical formula E-1.

Chemical formula E-1

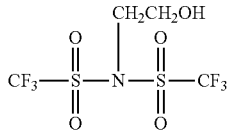

Synthesis of Anion Precursor E-2 (2-Hydroxyethyl Trifluoromethanesulfonate)

34.5 Grams of 2,6-lutidine (0.32 mol, manufactured by Tokyo Chemical Industry Co., Ltd.), 9.0 ml of ethylene glycol (0.16 mol, manufactured by Tokyo Chemical Industry Co., Ltd.), and 100 ml of anhydrous dichloromethane were loaded into a round bottom flask having placed therein a stirrer, and an atmosphere in the flask was replaced with nitrogen. The flask was placed in an ice bath and cooled to 0° C. After that, 54.1 ml (0.32 mol) of trifluoromethanesulfonic anhydride dissolved in 100 ml of anhydrous dichloromethane was dropped to the mixture with a syringe. The mixture was stirred for 1 hour at 0° C. and then stirred at from 0° C. to room temperature overnight. After the completion of the reaction, dilute hydrochloric acid (3%) was added to the resultant, and the mixture was subjected to a liquid separation with dichloromethane and water. An organic layer was dehydrated with magnesium sulfate and filtered, and then dichloromethane was distilled off under reduced pressure. Thus, a crude product was obtained. The crude product was subjected to silica gel column chromatography involving using dichloromethane as a developing solvent and dried. After that, 23.7 g of an anion precursor E-2 (2-hydroxyethyl trifluoromethanesulfonate) was obtained as a colorless and transparent liquid (0.12 mol, 76% yield).

The structure of the anion precursor E-2 is represented by the chemical formula E-2.

Chemical formula E-2

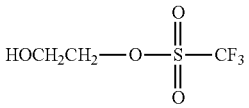

Synthesis of Anion Precursor E-3 (Aqueous Solution of Trifluoromethyltrifluoroboric acid)

In a flask, 20 g of a potassium salt of trifluoro(trifluoromethyl)boranic acid (0.15 mol, manufactured by Tokyo Chemical Industry Co., Ltd.) was dissolved in 100 ml of pure water. A potassium cation was exchanged with a hydrogen cation by passing the solution through a column filled with 200 ml of an acidic cation exchange resin Amberlite IR120B (manufactured by Organo Co., Ltd.). Then, an aqueous solution of trifluoromethyltrifluoroboric acid having an acid concentration of 18 mass % was synthesized. The synthesized aqueous solution was stored in a bottle made of polytetrafluoroethylene. An anion and a cation in the aqueous solution of an anion precursor E-3 are represented by the chemical formula E-3.

Chemical formula E-3

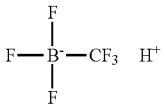

[3. Production Examples of Imidazoles]

Synthesis of G-1 (Polyvinylimidazole)

10 Grams of 1-vinylimidazole (0.11 mol, manufactured by Tokyo Chemical Industry Co., Ltd.), 20 ml of toluene, and 18 mg of azobisisobutyronitrile (manufactured by Tokyo Chemical Industry Co., Ltd., [1-vinylimidazole]/[azobisisobutyronitrile]=1,000/1) were loaded into a test tube, and deaeration and nitrogen replacement were repeated three times each. The test tube was hermetically sealed and the mixture was polymerized at 60° C. for 1 hour. After the reaction, the reaction solution was cooled and dropped in ethanol, and the mixture was filtered and dried. After that, 8.9 g of polyvinylimidazole was obtained (89% yield). The molecular weight of the synthesized polymer was measured by GPC involving using polystyrene as a standard sample.

Synthesis of G-2 (1-Hydroxyethyl-2-hydroxymethylimidazole)

20 Grams of 2-bromoethanol (0.16 mol, manufactured by Tokyo Chemical Industry Co., Ltd.) was dissolved in 200 ml of benzene (manufactured by Kanto Chemical Co., Inc.). 10.5 Grams of (1H-imidazol-2-yl)-methanol (0.11 mol, manufactured by Sigma-Aldrich) dissolved in 200 ml of benzene was dropped to the solution, and the mixture was heated to reflux for 42 hours at 85° C. After the completion of the reaction, the resultant was extracted by adding 800 ml of a 5 mass % aqueous solution of sodium carbonate, and a benzene layer was washed with water and dried. After that, benzene was distilled off. Thus, 12.7 g of G-2 (1-hydroxyethyl-2-hydroxymethylimidazole) was obtained as a yellow solid (84% yield).

[4. Production Examples of Ionic Electroconductive Agents]

Synthesis of Ionic Electroconductive Agent A-1; Ionic Electroconductive Agent Synthesis Method I-1 is used A stirrer was placed in a three-necked flask provided with a dropping funnel, and 30 ml of an aqueous solution of tris(hydroxyethyl)methylammonium hydroxide having a concentration of from 45% to 50% (corresponding to 78 mmol, manufactured by Tokyo Chemical Industry Co., Ltd.) and 308 ml of pure water were loaded into the flask to prepare an aqueous solution having a concentration of 0.23 mol/l, followed by nitrogen replacement. The flask was placed in an ice bath and the temperature of the reaction solution was kept at 0° C. While the temperature of the solution was kept at 0° C., an aqueous solution prepared by dissolving 21.9 g (78 mmol, 1.0 eq) of bis(trifluoromethanesulfonyl)amide (manufactured by Kanto Chemical Co., Inc.) in 30 ml of pure water was dropped to the solution with the dropping funnel over 30 minutes. After the completion of the dropping, the ice bath was removed and the temperature was returned to room temperature. The resultant was further subjected to a reaction for 2 hours and water was distilled off under reduced pressure. The residue was dried with a vacuum line to provide 34.6 g of an ionic electroconductive agent A-1 (tris(hydroxyethyl)methylammonium bis(trifluoromethanesulfonyl)imide) as a yellow liquid (100% yield).

A synthesis scheme for the ionic electroconductive agent A-1 is shown below.

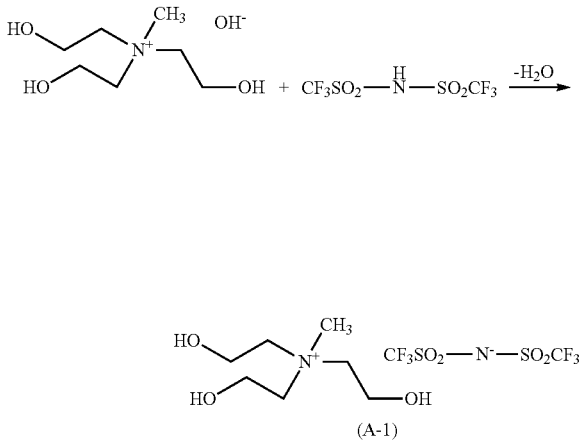

Synthesis of Ionic Electroconductive Agents A-3 to A-10, A-24, and A-25

Ionic electroconductive agents A-3 to A-10, A-24, and A-25 were synthesized in the same manner as in the synthesis of the ionic electroconductive agent A-1 except that the kinds and addition amounts of the hydroxide and the acid serving as raw materials were changed as shown in Table 3.

TABLE 3

| Ionic electro-con-ductive agent | Hydroxide | Addition amount (g) | Acid | Addition amount (g) |
|---|---|---|---|---|
| A-1 | Tris(hydroxyethyl)methylammonium hydroxide (45% to 50% aqueous solution, manufactured by Tokyo Chemical Industry Co., Ltd.) | 30 | Bis(trifluoromethanesulfonyl)amide (manufactured by Kanto Chemical Co., Inc.) | 21.9 |
| A-3 | | 30 | Bis(nonafluorobutanesulfonyl)amide (trade name: EF-N441S-30, 30% aqueous solution, manufactured by Mitsubishi Materials Electronic Chemicals Co., Ltd.) | 150.9 |
| A-4 | | 30 | 4,4,5,5,6,6-Hexafluorodihydro-4H-1,3,2-dithiazine 1,1,3,3-tetraoxide (manufactured by Wako Pure Chemical Industries, Ltd.) | 13.0 |
| A-5 | | 30 | Trifluoromethanesulfonic acid (manufactured by Tokyo Chemical Industry Co., Ltd.) | 11.7 |
| A-6 | Bis(hydroxyethyl)dimethylammonium hydroxide (50% aqueous solution, manufactured by Yokkaichi Chemical Company Limited) | 30 | Nonafluorobutanesulfonic acid (manufactured by Mitsubishi Materials Electronic Chemicals Co., Ltd.) | 29.8 |
| A-7 | Tris(hydroxyethyl)methylammonium hydroxide (45% to 50% aqueous solution, manufactured by Tokyo Chemical Industry Co., Ltd.) | 30 | Trifluoroacetic acid (manufactured by Tokyo Chemical Industry Co., Ltd.) | 8.9 |
| A-8 | Bis(hydroxyethyl)dimethylammonium hydroxide (50% aqueous solution, manufactured by Yokkaichi Chemical Company Limited) | 30 | Heptafluorobutyric acid (manufactured by Tokyo Chemical Industry Co., Ltd.) | 21.3 |
| A-9 | Tris(hydroxyethyl)methylammonium hydroxide (45% to 50% aqueous solution, manufactured | 30 | Tris(trifluoromethanesulfonyl)methide (manufactured by Synquest Chemicals) | 32.1 |
| A-10 | by Tokyo Chemical Industry Co., Ltd.) | 30 | E-3 (trifluoromethyltrifluoroboronic acid, 18% aqueous solution) | 59.7 |
| A-24 | | 30 | Hydrochloric acid (35% to 37%, manufactured by Kanto Chemical Co., Inc.) | 7.8 |
| A-25 | Aqueous solution of choline (48% to 50% aqueous solution, manufactured by Tokyo Chemical Industry Co., Ltd.) | 30 | Bis(trifluoromethanesulfonyl)amide (manufactured by Kanto Chemical Co., Inc.) | 34.1 |

Synthesis of Ionic Electroconductive Agent A-2; Ionic Electroconductive Agent Synthesis Method I-2 is Used A stirrer was placed in a three-necked flask provided with a Dimroth condenser, 30 g of N-methyldiethanolamine (0.25 mol, manufactured by Tokyo Chemical Industry Co., Ltd.) serving as a tertiary amine, 200 ml (1.25 mol/l) of ethyl acetate, and 74.4 g of N-methylbis(trifluoromethanesulfonyl)imide (0.25 mol, manufactured by Sigma-Aldrich) serving as an ester compound were loaded into the flask, and the mixture was refluxed under a nitrogen atmosphere for 20 hours. After the reaction, the reaction solution was cooled, and was subjected to a liquid separation with ethyl acetate and water. An organic layer was recovered, dehydrated with magnesium sulfate, filtered, and then dried to provide 78.6 g of an ionic electroconductive agent A-2 (bis(hydroxyethyl) dimethylammonium bis(trifluoromethanesulfonyl)imide) as a colorless and transparent liquid (76% yield).

A synthesis scheme for the ionic electroconductive agent A-2 is shown below.

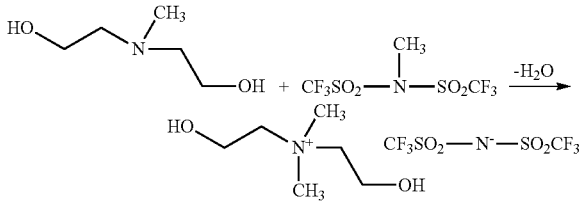

(A-2)

Synthesis of Ionic Electroconductive Agents A-11 to A-15, A-20, and A-21

Ionic electroconductive agents A-11 to A-15, A-20, and A-21 were synthesized in the same manner as in the synthesis of the ionic electroconductive agent A-2 except that the kinds and addition amounts of the tertiary amine and the ester compound serving as raw materials were changed as shown in Table 4.

TABLE 4

| Ionic electro-conductive agent | Tertiary amine | Addition amount (g) | Imidized product of anion | Addition amount (g) |
|---|---|---|---|---|
| A-2 | N-methyldiethanolamine (manufactured by Tokyo Chemical Industry Co., Ltd.) | 30 | N-Methyl bis(trifluoromethylsulfonyl)imide (manufactured by Sigma-Aldrich) | 74.4 |
| A-11 | Triethanolamine (manufactured by Tokyo Chemical Industry Co., Ltd.) | 30 | E-1 (N-hydroxyethyl bis(trifluoromethylsulfonyl)imide) | 65.4 |
| A-12 | 2-Pyridineethanol (manufactured by Tokyo Chemical Industry Co., Ltd.) | 30 | E-1 (N-hydroxyethyl bis(trifluoromethylsulfonyl)imide) | 79.3 |

TABLE 4-continued

| Ionic electro-conductive agent | Tertiary amine | Addition amount (g) | Imidized product of anion | Addition amount (g) |
|---|---|---|---|---|
| A-13 | 2-Pyridineethanol (manufactured by Tokyo Chemical Industry Co., Ltd.) | 30 | E-2 (2-hydroxyethyl trifluoromethanesulfonate) | 47.3 |
| A-14 | Poly(4-vinylpyridine) (manufactured by Kanto Chemical Co., Inc.) | 30 | N,N,N',N'-Tetra(trifluoromethanesulfonyl)-hexane-1,6-diamine (manufactured by Kanto Chemical Co., Inc.) | 184.0 |
| A-15 | Poly(dimethylaminoethyl methacrylate) (manufactured by Kanto Chemical Co., Inc.) | 30 | N,N,N',N'-Tetra(trifluoromethanesulfonyl)-hexane-1,6-diamine (manufactured by Kanto Chemical Co., Inc.) | 139.1 |
| A-16 | G-1 (polyvinylimidazole) | 30 | N,N,N',N'-Tetra(trifluoromethanesulfonyl)-hexane-1,6-diamine (manufactured by Kanto Chemical Co., Inc.) | 232.3 |
| A-14 | G-2 (1-hydroxyethyl-2-hydroxymethylimidazole) | 30 | E-1 (N-hydroxyethyl bis(trifluoromethylsulfonyl)imide) | 68.7 |
| A-15 | G-2 (1-hydroxyethyl-2-hydroxymethylimidazole) | 30 | N-Methyl bis(trifluoromethylsulfonyl)imide (manufactured by Sigma-Aldrich) | 62.3 |
| A-20 | N-Hydroxyethylpyrrolidone (manufactured by Tokyo Chemical Industry Co., Ltd.) | 30 | E-1 (N-hydroxyethyl bis(trifluoromethylsulfonyl)imide) | 84.8 |
| A-21 | N-Hydroxyethylpiperidine (manufactured by Tokyo Chemical Industry Co., Ltd.) | 30 | E-1 (N-hydroxyethyl bis(trifluoromethylsulfonyl)imide) | 75.6 |

Synthesis of Ionic Electroconductive Agent A-16

(Ionic Electroconductive Agent Synthesis Method I-3 is Used)

Grams (56.3 mmol) of G-2 (1-hydroxyethyl-2-hydroxymethylimidazole), 10.1 g of dimethyl carbonate (0.11 mol, manufactured by Kanto Chemical Co., Inc.), and 50 ml of methanol were loaded into a pressure-resistant reaction vessel made of stainless steel provided with a stirring machine, a temperature gauge, and a heating-cooling apparatus, and G-2 and dimethyl carbonate were dissolved in methanol by stirring the mixture at room temperature. Next, the vessel was hermetically sealed, the temperature of the reaction solution was increased to 130° C. while the reaction solution was stirred, and the reaction solution was subjected to a reaction at 130° C. for 40 hours while a pressure in the reaction vessel was kept at 0.5 MPa or less. After that, the reaction solution was cooled to 25° C. to provide 50 ml of a solution of 1-hydroxyethyl-2-hydroxymethyl-3-methylimidazolium monomethyl carbonate in methanol (1.13 mol/l in terms of the concentration of the carbonate).

Next, an aqueous solution prepared by dissolving 31.7 g of bis(trifluoromethanesulfonyl)amide (0.11 mol, manufactured by Kanto Chemical Co., Inc.) serving as an anion raw material in 20 ml of pure water at room temperature was dropped to 50 ml of the resultant solution of the imidazolium carbonate in methanol. After the mixture had been stirred for 30 minutes, it was confirmed that the occurrence of the air bubbles of carbonic acid stopped, and then the solvent was distilled off under reduced pressure. The resultant solution was subjected to a liquid separation with ethyl acetate and water, and an organic layer was dehydrated with magnesium sulfate and filtered. After that, the solvent was distilled off under reduced pressure. The resultant viscous liquid was dried to provide 16.5 g of an ionic electroconductive agent A-16 (1-hydroxyethyl-2-hydroxymethyl-3-methylimidazolium bis(trifluoromethanesulfonyl)imide) as a colorless and transparent liquid (37.7 mmol, 67% yield).

Synthesis of Ionic Electroconductive Agents A-17 to A-19

Ionic electroconductive agents A-17 to A-19 were synthesized in the same manner as in the synthesis of the ionic electroconductive agent A-16 except that the amounts of G-2, dimethyl carbonate, and methanol to be used in the reaction were not changed, and the kind and blending amount of the anion raw material were changed as shown in Table 5.

TABLE 5

| Ionic electroconductive agent | Anion raw material | Anion raw material (g) |
|---|---|---|
| A-16 | Bis(trifluoromethanesulfonyl)amide (manufactured by Kanto Chemical Co., Inc.) | 31.7 |
| A-17 | Hexafluorophosphoric acid (55% aqueous solution, manufactured by Sigma-Aldrich) | 29.9 |
| A-18 | Hexafluoroarsenic acid (30% aqueous solution, manufactured by Strem Chemicals, Inc.) | 71.4 |
| A-19 | Hexafluoroantimonic acid (manufactured by Sigma-Aldrich) | 26.7 |

Synthesis of Ionic Electroconductive Agent A-22; Production Method Except Ionic Electroconductive Agent Synthesis Methods I-1 to I-3 (Hereinafter Referred to as "Synthesis Method I-4")

30 Grams of triethanolamine (0.20 mol, manufactured by Tokyo Chemical Industry Co., Ltd.) serving as a nucleophile was dissolved in 50 ml of acetonitrile, and 57.2 g of iodomethane (0.40 mol, manufactured by Tokyo Chemical Industry Co., Ltd.) was added to the solution at room temperature. After that, the mixture was heated to reflux at 90° C. for 72 hours. After that, the solvent was distilled off under reduced pressure. The resultant concentrate was washed with diethyl ether and the supernatant was removed by decantation. The washing and decantation operations were repeated three times each to provide a residue. The resultant residue is a mixture containing tris(hydroxyethyl) methylammonium iodide.

The resultant residue was dissolved in 200 ml of acetone in a flask for exchanging an iodide ion with the target anion. After that, 104 g of lithium bis(trifluromethanesulfonyl)

imide (0.36 mol, manufactured by Kanto Chemical Co., Inc.) serving as an anion raw material dissolved in 100 ml of acetone was added to the solution, and the mixture was stirred for 24 hours at room temperature. The target ionic electroconductive agent was insoluble in ethyl acetate, and hence the mixture was subjected to a liquid separation with ethyl acetate and water, and an aqueous layer was recovered. Water was distilled off under reduced pressure, and the resultant yellow liquid was dried under reduced pressure for 12 hours while being heated at 60° C. Thus, 60 g of an ionic electroconductive agent A-22 (tris(hydroxyethyl)methylammonium bis(trifluoromethanesulfonyl)imide) was obtained as a yellow liquid (0.13 mol, 67% yield).

Synthesis of Ionic Electroconductive Agents A-26 to A-32

Ionic electroconductive agents A-26 to A-32 were synthesized in the same manner as in the synthesis of the ionic electroconductive agent A-22 except that the kind and blending amount of the anion raw material to be used in the reaction were changed as shown in Table 6.

TABLE 6

| Ionic electroconductive agent | Anion raw material | Addition amount (g) |
|---|---|---|
| A-22 | Lithium bis(trifluoromethanesulfonyl)imide (manufactured by Kanto Chemical Co., Inc.) | 104 |

TABLE 6-continued

| Ionic electroconductive agent | Anion raw material | Addition amount (g) |
|---|---|---|
| A-26 | Iron(III) trifluoromethanesulfonate (manufactured by Sigma-Aldrich) | 57.0 |
| A-27 | Copper trifluoromethanesulfonate (manufactured by Tokyo Chemical Industry Co., Ltd.) | 41.1 |
| A-28 | Silver bis(trifluoromethanesulfonyl)imide (manufactured by Tokyo Chemical Industry Co., Ltd.) | 44.0 |
| A-29 | Barium trifluoromethanesulfonate (manufactured by Wako Pure Chemical Industries, Ltd.) | 49.3 |
| A-30 | Magnesium trifluoromethanesulfonate (manufactured by Tokyo Chemical Industry Co., Ltd.) | 36.5 |
| A-31 | Cesium tris(trifluoromethanesulfonyl)methide (manufactured by Central Glass Co., Ltd.) | 61.7 |
| A-32 | Potassium trifluoromethanesulfonate (manufactured by Tokyo Chemical Industry Co., Ltd.) | 21.3 |

Ionic Electroconductive Agent A-23

Commercially available butyltrimethylammonium bis(trifluoromethanesulfonyl)imide was used as an ionic electroconductive agent A-23.

The foregoing ionic electroconductive agents A-1 to A-32 are collectively shown in Table 7.

TABLE 7

| Ionic electroconductive agent | Cation skeleton | Number of hydroxyl groups | Anion | Ionic electroconductive agent synthesis method |
|---|---|---|---|---|
| A-1 | Ammonium | 3 | Bis(trifluoromethanesulfonyl)imide anion | (I-1) |
| A-2 | | 2 | Bis(trifluoromethanesulfonyl)imide anion | (I-2) |
| A-3 | | 3 | Bis(nonafluorobutanesulfonyl)imide anion | (I-1) |
| A-4 | | 3 | 4,4,5,5,6,6-Hexafluorodihydro-4H-1,3,2-dithiazine 1,1,3,3,-tetraoxide anion | |
| A-5 | | 3 | Trifluoromethanesulfonate anion | |
| A-6 | | 2 | Nonafluorobutanesulfonate anion | |
| A-7 | | 3 | Trifluoroacetate anion | |
| A-8 | | 2 | Heptafluorobutyrate anion | |
| A-9 | | 3 | Tris(trifluoromethanesulfonyl)methide anion | |
| A-10 | | 3 | Trifluoromethyltrifluoroborate anion | |
| A-11 | | 4 | Bis(trifluoromethanesulfonyl)imide anion | (I-2) |
| A-12 | Pyridinium | 2 | Bis(trifluoromethanesulfonyl)imide anion | |
| A-13 | | 2 | Trifluoromethanesulfonate anion | |
| A-14 | Imidazolium | 3 | Bis(trifluoromethanesulfonyl)imide anion | |
| A-15 | | 2 | Trifluoromethanesulfonate anion | |
| A-16 | | 2 | Bis(trifluoromethanesulfonyl)imide anion | (I-3) |
| A-17 | | 2 | Hexafluorophosphate anion | |
| A-18 | | 2 | Hexafluoroarsenate anion | |
| A-19 | | 2 | Hexafluoroantimonate anion | |
| A-20 | Pyrrolidinium | 2 | Bis(trifluoromethanesulfonyl)imide anion | (I-2) |
| A-21 | Piperidinium | 2 | Bis(trifluoromethanesulfonyl)imide anion | |
| A-22 | Ammonium | 3 | Bis(trifluoromethanesulfonyl)imide anion | (I-4) |
| A-23 | | 0 | Bis(trifluoromethanesulfonyl)imide anion | Commercially available |
| A-24 | | 3 | Chloride anion | (I-1) |
| A-25 | | 1 | Bis(trifluoromethanesulfonyl)imide anion | |
| A-26 | | 3 | Trifluoromethanesulfonate anion | (I-4) |
| A-27 | | 3 | Trifluoromethanesulfonate anion | |
| A-28 | | 3 | Bis(trifluoromethanesulfonyl)imide anion | |
| A-29 | | 3 | Trifluoromethanesulfonate anion | |
| A-30 | | 3 | Trifluoromethanesulfonate anion | |
| A-31 | | 3 | Tris(trifluoromethanesulfonyl)methide anion | |
| A-32 | | 3 | Trifluoromethanesulfonate anion | |

[5. Production Examples of Isocyanate Group-Terminated Prepolymers]

Synthesis of Isocyanate Group-Terminated Prepolymer B-1

A nitrogen atmosphere was established in a reaction vessel, and 38 parts by mass of an isocyanate D-1 (polymeric MDI (trade name: MILLIONATE MR200; manufactured by Nippon Polyurethane Industry Co., Ltd.)) was loaded into the reaction vessel. Next, while a temperature in the reaction vessel was held at 65° C., 100 parts by mass of a polyol F-1 (poly(tetramethylene glycol) (trade name: PTMG2000; manufactured by Mitsubishi Chemical Corporation)) was gradually dropped in the reaction vessel. After the completion of the dropping, the mixture was subjected to a reaction at a temperature of 65° C. for 2 hours. The resultant reaction mixture was cooled to room temperature and diluted with 50 parts by mass of methyl ethyl ketone (hereinafter referred to as "MEK") to provide a solution of an isocyanate group-terminated prepolymer B-1 having an isocyanate group content of 3.4 mass %.

Synthesis of Isocyanate Group-terminated Prepolymers B-2 to B-4

Isocyanate group-terminated prepolymers B-2 to B-4 were synthesized in the same manner as in the case of the isocyanate group-terminated prepolymer B-1 except that the kinds of the isocyanate and polyol to be used in the reaction were changed as shown in Table 8 and Table 9, and their blending amounts were changed as shown in Table 10.

TABLE 8

| Isocyanate | |
|---|---|
| Polymeric MDI (tradename: MILLIONATE MR200 manufactured by Nippon Polyurethane Industry Co., Ltd.) | D-1 |
| Tolylene diisocyanate (TDI) (tradename: COSMONATE T80, manufactured by Mitsui Chemicals, Inc.) | D-2 |

TABLE 9

| Polyol | |
|---|---|
| Poly(tetramethylene glycol) (trade name: PTMG2000; manufactured by Mitsubishi Chemical Corporation) | F-1 |
| Polyethylene glycol (trade name: PEG-2000; manufactured by Sanyo Chemical Industries, Ltd.) | F-2 |
| Polybutylene adipate-based polyol (trade name: NIPPOLLAN 4010; manufactured by Nippon Polyurethane Industry Co., Ltd.) | F-3 |
| Polypropylene glycol-based polyol (trade name: SANNIX PP-1000; manufactured by Sanyo Chemical Industries, Ltd.) | F-4 |

TABLE 10

| Isocyanate group-terminated prepolymer | Isocyanate | Addition amount of isocyanate (parts by mass) | Polyol | Addition amount of polyol (parts by mass) | Addition amount of methyl ethyl ketone (parts by mass) | Isocyanate content (%) |
|---|---|---|---|---|---|---|
| B-1 | D-1 | 38 | F-1 | 100 | 50 | 3.4 |
| B-2 | D-1 | 31 | F-2 | 100 | 50 | 2.9 |
| B-3 | D-2 | 24 | F-3 | 100 | 50 | 3.3 |
| B-4 | D-2 | 35 | F-4 | 100 | 50 | 4.5 |

[6. Production Examples of Paints]

(Paint 1)

Materials shown in Table 11 below serving as materials for a surface layer were stirred and mixed. Next, MEK was added to the mixture so that a total solid content ratio became 30 mass %. After that, zirconia beads (median particle diameter: 0.8 mm) were loaded in an amount twice as large as the mass of the mixed liquid, and the contents were mixed by using a sand mill whose inner wall was made of zirconia. Further, the viscosity of the resultant was adjusted to from 10 cps to 13 cps with MEK. Thus, a paint for forming a surface layer was prepared.

TABLE 11

| | Material | Part(s) by mass |
|---|---|---|
| Reactive compound | Isocyanate-terminated prepolymer B-1 | 85 |
| Polyol | Polyol C-1 | 56 |
| Ionic electroconductive agent | ionic electroconductive agent A-1 | 1 |
| Roughness-controlling fine particles | Urethane resin fine particles (trade name, Art-pearl C-400; manufactured by Negami Chemical Industrial Co., Ltd) | 90 |

(Paints 2 to 13, 18 to 24, 26, 27, and 29 to 37)

Respective paints were produced in the same manner as in the paint 1 except that materials shown in Table 12 to Table 14 below were used as materials for surface layers.

TABLE 12

| | Polyol | Hydroxyl value (mg KOH/g) |
|---|---|---|
| C-1 | Poly(tetramethylene glycol) (trade name: PTMG2000; manufactured by Mitsubishi Chemical Corporation) | 56 |
| C-2 | PTG-L2000 (manufactured by Hodogaya Chemical Co., Ltd.) | 56 |
| C-3 | NEWPOL NP-300 (manufactured by Sanyo Chemical Industries, Ltd.) | 768 |
| C-4 | Polypropylene glycol-based polyol (trade name: SANNIX PP-1000; manufactured by Sanyo Chemical Industries, Ltd.) | 112 |
| C-5 | Polyethylene glycol (trade name: PEG-2000; manufactured by Sanyo Chemical Industries, Ltd.) | 56 |

TABLE 13

| Reactive compound | |
|---|---|
| Bisphenol A diglycidyl ether (manufactured by Tokyo Chemical Industry Co., Ltd.) | R-2 |
| 2,4,6-Tris[bis(methoxymethyl)amino]-1,3,5-triazine (manufactured by Tokyo Chemical Industry Co., Ltd.) | R-3 |

TABLE 14

| Paint | Ionic electroconductive agent | Addition amount (part(s) by mass) | Isocyanate group-terminated prepolymer or reactive compound | Addition amount (parts by mass) | Polyol | Addition amount (parts by mass) |
|---|---|---|---|---|---|---|
| Paint 1 | A-1 | 1.0 | B-1 | 85 | C-1 | 56 |
| Paint 2 | A-2 | 1.0 | B-2 | 99 | | 57 |
| Paint 3 | A-3 | 0.5 | B-1 | 82 | | 58 |
| Paint 4 | A-4 | 2.9 | | 94 | | 50 |
| Paint 5 | A-5 | 9.1 | | 144 | | 19 |
| Paint 6 | A-6 | 1.0 | | 84 | | 57 |
| Paint 7 | A-7 | 1.0 | | 89 | | 55 |
| Paint 8 | A-8 | 1.0 | | 85 | | 57 |
| Paint 9 | A-9 | 1.0 | | 81 | C-2 | 54 |
| Paint 10 | A-10 | 1.0 | | 180 | C-3 | 9 |
| Paint 11 | A-11 | 1.0 | | 120 | C-4 | 40 |
| Paint 12 | A-12 | 1.0 | | 83 | C-5 | 57 |
| Paint 13 | A-13 | 19.0 | | 163 | None | 0 |
| Paint 18 | A-15 | 1.0 | B-4 | 70 | C-1 | 64 |
| Paint 19 | A-16 | 1.0 | B-1 | 84 | | 57 |
| Paint 20 | A-17 | 0.5 | | 83 | | 58 |
| Paint 21 | A-18 | 2.9 | | 92 | | 51 |
| Paint 22 | A-19 | 9.1 | | 111 | | 35 |
| Paint 23 | A-20 | 1.0 | | 84 | | 57 |
| Paint 24 | A-21 | 1.0 | | 83 | | 57 |
| Paint 26 | A-23 | 1.0 | | 80 | | 59 |
| Paint 27 | A-24 | 1.0 | | 92 | | 53 |
| Paint 29 | A-22 | 1.0 | | 85 | | 56 |
| Paint 30 | A-25 | 1.0 | | 82 | | 58 |
| Paint 31 | A-26 | 1.0 | | 89 | | 56 |
| Paint 32 | A-27 | 1.0 | | 89 | | 56 |
| Paint 33 | A-28 | 1.0 | | 85 | | 56 |
| Paint 34 | A-29 | 1.0 | | 88 | | 55 |
| Paint 35 | A-30 | 1.0 | | 88 | | 55 |

TABLE 14-continued

| Paint | Ionic electroconductive agent | Addition amount (part(s) by mass) | Isocyanate group-terminated prepolymer or reactive compound | Addition amount (parts by mass) | Polyol | Addition amount (parts by mass) |
|---|---|---|---|---|---|---|
| Paint 36 | A-31 | 1.0 | | 84 | | 57 |
| Paint 37 | A-32 | 1.0 | | 88 | | 55 |

Paints 14 to 16 to be used in the production of a resin based on the method according to the method (J-2) were prepared as described below.

(Paint 14)

Materials shown in Table 15 below serving as materials for a surface layer were stirred and mixed. Next, a paint 14 was prepared in the same manner as in the case of the paint 1.

TABLE 15

| | Material | Part(s) by mass |
|---|---|---|
| Reactive compound | Isocyanate group-terminated prepolymer B-1 | 80 |
| Polyol | Polyol C-1 | 59 |
| Amine compound | Poly(4-vinylpyridine) (hereinafter "P4VP") (manufactured by Kanto Chemical Co., Inc.) | 0.25 |
| Anion precursor | N,N,N',N'-tetra(trifluoromethanesulfonyl)-hexane-1,6-diamine (hereinafter "C6TFSA") (manufactured by Kanto Chemical Co., Inc.) | 0.75 |
| Roughness-controlling fine particles | Urethane resin fine particles (trade name: Art-pearl C-400; manufactured by Negami Chemical Industrial Co., Ltd.) | 90 |

(Paints 15 and 16)

Respective paints were produced in the same manner as in the preparation of the paint 14 except that materials shown in Table 16 below were used as materials for surface layers.

TABLE 16

| Paint | Reactive compound | Addition amount (part(s) by mass) | Polyol | Addition amount (part(s) by mass) | Amine compound | Addition amount (part(s) by mass) | Anion precursor | Addition amount (part(s) by mass) |
|---|---|---|---|---|---|---|---|---|
| Paint 14 | B-1 | 80 | C-1 | 59 | Poly(4-vinylpyridine) (P4VP, manufactured by Kanto Chemical Co., Inc.) | 0.25 | N,N,N',N'-tetra(trifluoromethanesulfonyl)-hexane-1,6-diamine (C6TFSA, manufactured by Kanto Chemical Co., Inc.) | 0.75 |
| Paint 15 | B-3 | 81 | C-1 | 58 | Poly(dimethylaminoethyl methacrylate) (PDMAEMA, manufactured by Kanto Chemical Co., Inc.) | 0.30 | N,N',N',-tetra(trifluoromethanesulfonyl)-dodecane-1,12-diamine (C12TFSA, manufactured by Kanto Chemical Co., Inc.) | 0.70 |
| Paint 16 | R-2 | 14 | C-1 | 84 | G-1 (polyvinylimidazole) | 0.20 | N,N,N',N'-tetra(trifluoromethanesulfonyl)-dodecane-1,12-diamine (C12TFSA, manufactured by Kanto Chemical Co., Inc.) | 0.80 |

(Paint 17)

Materials shown in Table 17 below serving as materials for a surface layer were stirred and mixed. Next, a paint 17 was prepared in the same manner as in the case of the paint 1.

TABLE 17

| | Material | Part(s) by mass |
|---|---|---|
| Reactive compound | Reactive compound R-3 | 1 |
| Polyol | Polyol C-1 | 98 |
| Ionic electroconductive agent | Ionic electroconductive agent A-14 | 1 |
| Roughness-controlling fine particles | Urethane resin fine particles (trade name: Art-pearl C-400; manufactured by Negami Chemical Industrial Co., Ltd.) | 90 |

(Paint 25)

A paint 25 was prepared in the same manner as in the paint 29 except that soda glass beads (median particle diameter: 0.8 mm) were used instead of the zirconia beads in the mixing of the paint materials.

(Paint 28)

A paint 28 was prepared in the same manner as in the paint 1 except that soda glass beads (median particle diameter: 0.8 mm) were used instead of the zirconia beads in the mixing of the paint materials.

Example 1

A coating film of the paint 1 prepared in advance was formed on the surface of the elastic layer of the elastic roller D-1 produced in advance by immersing the elastic roller D-1 in the paint 1, and was dried. Further, a surface layer having a thickness of about 15 μm was formed on the outer periphery of the elastic layer by subjecting the resultant to heat treatment at a temperature of 160° C. for 1 hour. Thus, a member for electrophotography according to Example 1 was produced.

Examples 2 to 15, 19 to 24, and 30 to 32, and Comparative Examples 1 to 5 and 8 to 11

Members for electrophotography according to Examples 2 to 15, 19 to 25, and 30 to 32, and Comparative Examples 1 to 5 and 8 to 11 were produced in the same manner as in Example 1 except that the kind of the paint used in Example 1 was changed as shown in Table 18.

Examples 16 to 18

Members for electrophotography according to Examples 16 to 18 were produced in the same manner as in Example 1 except that the heat treatment temperature was changed to 180° C. and the kind of the paint was changed as shown in Table 18.

Example 25

The paint 1 was changed to the paint 25 and a surface layer was formed on the outer periphery of the elastic roller D-1 in the same manner as in Example 1. After that, the elastic roller was immersed in 1,000 ml of pure water so that its entirety was covered with the pure water, and the roller was left to stand at 23° C. for 7 days. After that, the elastic roller was removed and dried at 120° C. for 3 hours. Thus, a member for electrophotography according to Example 25 was produced.

Example 26

A member for electrophotography according to Example was produced by performing application, drying, and heating in the same manner as in Example 1 except that the elastic roller D-1 was changed to the elastic roller D-2.

Example 27 and Comparative Example 6

Members for electrophotography according to Example 27 and Comparative Example 6 were produced in the same manner as in Example 26 except that the kind of the paint used in Example 26 was changed as shown in Table 18.

Example 28

Figure 4:
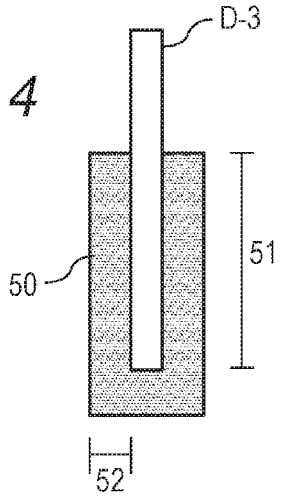
FIG. 4 is a view for illustrating a section of a developing blade according to the present invention.

FIG. 4 is a view for illustrating a section of a developing blade according to the present invention. A coating film of the paint 1 was formed on the surface of the supporting substrate D-3 produced in advance by immersing the supporting substrate in the paint so that a length 51 from a longitudinal side end portion thereof became 1.5 mm, and the coating film was dried. Further, a resin layer 50 having a thickness 52 of about 15 μm was arranged on the surface of the longitudinal side end portion of the SUS sheet by subjecting the resultant to a heat treatment at a temperature of 160° C. for 1 hour. Thus, a developing blade according to Example 28 was produced.

Example 29 and Comparative Example 7

Developing blades according to Example 29 and Comparative Example 7 were produced in the same manner as in Example 28 except that the kind of the paint used in Example 28 was changed as shown in Table 18.

TABLE 18

| Example | Paint | Elastic roller, supporting substrate | Ionic electro-conductive agent | Amine compound | Anion precursor | Dispersion media | Washing of roller |
|---|---|---|---|---|---|---|---|
| Example 1 | Paint 1 | D-1 | A-1 | None | | Zirconia beads | Absent |
| Example 2 | Paint 2 | | A-2 | | | | |
| Example 3 | Paint 3 | | A-3 | | | | |
| Example 4 | Paint 4 | | A-4 | | | | |
| Example 5 | Paint 5 | | A-5 | | | | |
| Example 6 | Paint 6 | | A-6 | | | | |

TABLE 18-continued

| Example | Paint | Elastic roller, supporting substrate | Ionic electro-conductive agent | Amine compound | Anion precursor | Dispersion media | Washing of roller |
|---|---|---|---|---|---|---|---|
| Example 7 | Paint 7 | | A-7 | | | | |
| Example 8 | Paint 8 | | A-8 | | | | |
| Example 9 | Paint 9 | | A-9 | | | | |
| Example 10 | Paint 10 | | A-10 | | | | |
| Example 11 | Paint 11 | | A-11 | | | | |
| Example 12 | Paint 12 | | A-12 | | | | |
| Example 13 | Paint 13 | | A-13 | | | | |
| Example 14 | Paint 14 | | None | P4VP | C6TFSA | | |
| Example 15 | Paint 15 | | | PDMAEMA | C12TFSA | | |
| Example 16 | Paint 16 | | | G-1 | C12TFSA | | |
| Example 17 | Paint 17 | | A-14 | None | | | |
| Example 18 | Paint 18 | | A-15 | | | | |
| Example 19 | Paint 19 | | A-16 | | | | |
| Example 20 | Paint 20 | | A-17 | | | | |
| Example 21 | Paint 21 | | A-18 | | | | |
| Example 22 | Paint 22 | | A-19 | | | | |
| Example 23 | Paint 23 | | A-20 | | | | |
| Example 24 | Paint 24 | | A-21 | | | | |
| Example 25 | Paint 25 | | A-22 | | | Glass beads | Present |
| Example 26 | Paint 1 | D-2 | A-1 | None | | Zirconia | Absent |
| Example 27 | Paint 19 | | A-16 | | | beads | |
| Example 28 | Paint 1 | D-3 | A-1 | | | | |
| Example 29 | Paint 2 | | A-2 | | | | |
| Example 30 | Paint 31 | D-1 | A-26 | | | | |
| Example 31 | Paint 32 | | A-27 | | | | |
| Example 32 | Paint 33 | | A-28 | | | | |
| Comparative Example 1 | Paint 26 | D-1 | A-23 | | | | |
| Comparative Example 2 | Paint 27 | | A-24 | | | | |
| Comparative Example 3 | Paint 28 | | A-1 | | | Glass beads | |
| Comparative Example 4 | Paint 29 | | A-22 | | | Zirconia | |
| Comparative Example 5 | Paint 30 | | A-25 | | | beads | |
| Comparative Example 6 | Paint 29 | D-2 | A-22 | | | | |
| Comparative Example 7 | Paint 27 | D-3 | A-24 | | | | |
| Comparative Example 8 | Paint 34 | D-1 | A-29 | | | | |
| Comparative Example 9 | Paint 35 | | A-30 | | | | |
| Comparative Example 10 | Paint 36 | | A-31 | | | | |
| Comparative Example 11 | Paint 37 | | A-32 | | | | |

The fact that the resin in each surface layer contains a structure according the present invention can be confirmed by analysis based on a known analysis method, i.e., pyrolysis GC/MS, evolved gas analysis (EGA-MS), FT-IR, or NMR.

[Evaluation of Member for Electrophotography]

First, the members for electrophotography according to Examples 1 to 25 and 30 to 32, and Comparative Examples 1 to 5 and 8 to 11 produced in advance were each used as a developing roller and evaluated for the following items.

1. Evaluation as Developing Roller

<1-1. Resistance Value of Developing Roller>

Figure 5A:
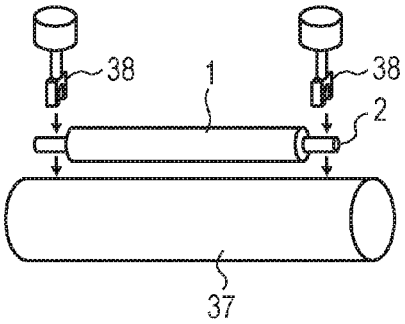
FIG. 5A is a schematic construction view of an apparatus for measuring the electric resistance value of a member for electrophotography.
Figure 5B:
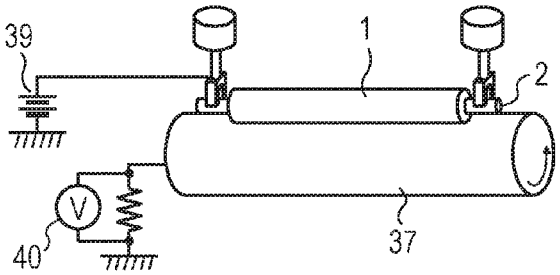
FIG. 5B is a schematic construction view of the apparatus for measuring the electric resistance value of a member for electrophotography.

The electric resistance value of a developing roller upon application of a DC voltage to the developing roller as illustrated in FIG. 5A and FIG. 5B was measured. As the electroconductivity of an electroconductive layer becomes higher, the electric resistance value of a developing roller to be obtained reduces. First, in FIG. 5A, a developing roller was brought into contact with a rotating columnar metal 37 having a diameter of 40 mm by pressing both ends of an electroconductive substrate 2 at loads of 4.9 N each through electroconductive bearings 38. Thus, the developing roller was caused to rotate following the metal at a speed of 60 rpm. Next, as illustrated in FIG. 5B, a voltage of 50 V was applied from a high-voltage power source 39 to the developing roller, and a potential difference across a resistor having a known electric resistance (the electric resistance was lower than the electric resistance of the developing roller by 2 or more orders of magnitude) arranged between the columnar metal 37 and the ground was measured. A voltmeter 40 (189 TRUE RMS MULTIMETER manufactured by Fluke) was used in the measurement of the potential difference. A current that had flowed in the columnar metal 37 through the developing roller was determined by calculation from the measured potential difference and the electric resistance of the resistor. Here, in the measurement of the potential difference, 2 seconds after the application of the voltage, sampling was performed for 3 seconds and a value calculated from the average of the values obtained by the sampling was defined as a roller current value. The electric resistance value of the developing roller was determined by dividing the applied voltage of 50 V by the resultant current. The measurement was performed by using a developing roller, which had been left to stand in an environment having a temperature of 23° C. and a relative humidity of 55% (hereinafter referred to as "N/N environment") for 6 hours or more, in the N/N environment.

<1-2. Triboelectric Charge Quantity of Developing Roller>

The measurement of the triboelectric charge quantity of a developing roller was performed in accordance with the following procedure under an environment having a temperature of 35° C. and a relative humidity of 85% (hereinafter referred to as "H/H environment") after the roller had been left to stand in the H/H environment for 6 hours or more.

Figure 6:
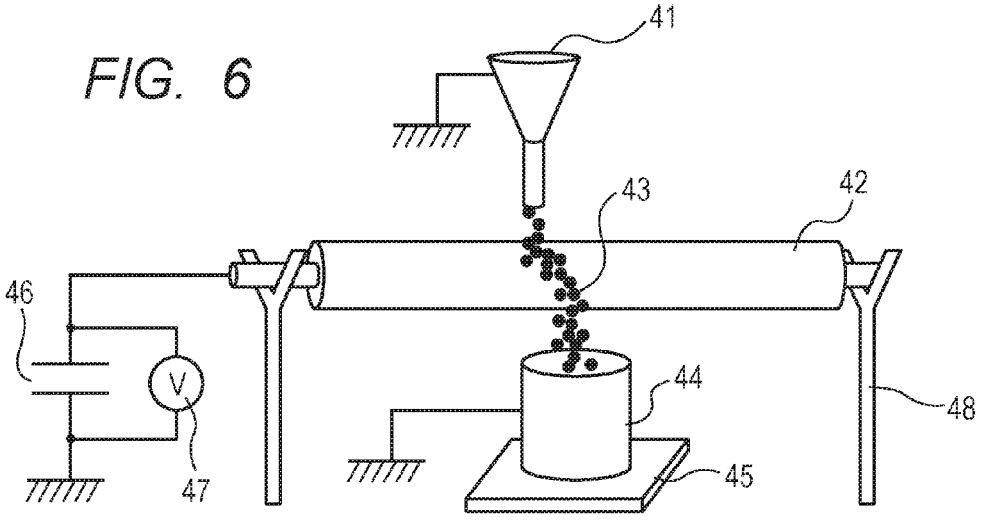
FIG. 6 is a schematic construction view of an apparatus for measuring the triboelectric charge quantity of a member for electrophotography.

A measuring portion illustrated in FIG. 6 was connected to a cascade-type surface charge quantity-measuring apparatus TS-100AT (trade name, manufactured by Kyocera Chemical Corporation) before its use in the measurement.

As illustrated in FIG. 6, the substrate of a developing roller 42 was supported by insulating support rods 48, and a carrier 43 was loaded into a powder input port 41 and caused to fall for 10 seconds so that contact charging was caused to occur in the carrier 43. A standard carrier N-01 (the Imaging Society of Japan) was used as the carrier. The total charge quantity of the carrier 43 that had fallen into a receiving dish 44 placed on an insulating plate 45 was measured with a potentiometer 47 connected in parallel with a capacitor 46, and was defined as a charge quantity Q [μC]. Further, the mass (g) of the carrier that had fallen into the receiving dish 44 was measured, and a charge quantity Q/M (μC/g) per unit mass determined from those values was defined as a charge quantity. It should be noted that the triboelectric charge quantity obtained by the developing roller in this measurement was defined as a "charge quantity 1."

<1-3. Content of Metal Element in Electroconductive Layer of Developing Roller>

The content of a metal in the electroconductive layer of a developing roller was evaluated. First, the electroconductive layer covering the surface of the developing roller was peeled. The peeled electroconductive layer was accurately weighed and asked by heating, the ash was dissolved in nitric acid and hydrofluoric acid by heating, and the solution was dried and hardened. After that, the hardened product was dissolved in dilute nitric acid so that a constant volume was obtained. The resultant constant-volume liquid was subjected to inductively coupled plasma-mass spectroscopy (ICP-MS analysis) with an ICP mass spectrometer (Agilent 4500 manufactured by Agilent Technologies). A calibration curve was created for each metal from a solution having a known concentration, the measurement was performed for each sample twice, and the average of the two measured values was defined as the content of each metal. Only detected metals were shown in tables. The content of any other metal was equal to or less than the minimum limit of detection (1 ppm).

<1-4. Regulation Failure Evaluation>

A developing roller serving as an evaluation object was loaded into a laser printer (trade name: LBP7700C; manufactured by Canon Inc.), and an evaluation for a regulation failure was performed. First, the laser printer into which the developing roller serving as an evaluation object had been loaded was placed in an environment having a temperature of 20° C. and a relative humidity of 30% (hereinafter referred to as "L/L environment") and then left to stand for 6 hours or more. Next, a black image having a print percentage of 1% was continuously output on 100 sheets of copier paper, and then a solid white image was output on new copier paper. After those images had been output, the state of a toner coat on the surface of the developing roller was observed, and the presence or absence of electrostatic toner agglomeration (regulation failure) resulting from excessive charging of toner was visually observed. The result of the observation was evaluated by the following criteria.

A: No regulation failure is present on the toner coat.

B: A regulation failure is present on the toner coat but does not appear in any image.

C: A regulation failure appears in an image.

<1-5. Fogging Image Evaluation>

First, a developing roller was left to stand in an environment having a temperature of 45° C. and a relative humidity of 95% for 14 days. The developing roller after the standing was loaded into a laser printer, placed in the H/H environment as in the regulation failure evaluation, and left to stand for 6 hours or more. Next, after an image having a print percentage of 1% had been continuously output on 100 sheets of copier paper, a solid white image was output on new copier paper, and the printer was stopped during the output of the solid white image. At this time, a developer adhering onto a photosensitive member was peeled off with a tape (trade name: CT18; manufactured by Nichiban Co., Ltd.), and a reflectance $R_1$ was measured with a reflection densitometer (trade name: TC-6DS/A; manufactured by Tokyo Denshoku Co., Ltd.). The reduction amount "$R_0-R_1$" (%) of the reflectance with reference to the reflectance $R_0$ of the tape was measured, and the measured value was defined as a fogging value.

<1-6. Triboelectric Charge Quantity of Developer>

A triboelectric charge quantity was measured for evaluating the charge-providing performance of the developing roller for the developer. At the time of the evaluation for a fogging image, the developer carried by a portion having the narrower circumferential-direction width out of the portions of the developing roller sandwiched between a developer-regulating blade and the position at which the developing roller abutted with the photosensitive member was sucked and collected with a metal cylindrical tube and a cylindrical filter. At that time, the quantity of charge stored in a capacitor through the metal cylindrical tube and the mass of the sucked developer were measured with a measuring machine (trade name: 8252; manufactured by ADC Corporation). A charge quantity per unit mass (μC/g) was calculated from those values. When a negatively chargeable developer is used, the sign of its charge quantity per unit mass is negative, and it can be said that as the absolute value of the charge quantity increases, the charge-providing performance of the developing roller becomes higher. It should be noted that the triboelectric charge quantity obtained by the developing roller in this measurement was defined as a "charge quantity 2."

TABLE 19

| Example | Roller resistance value (Ω) | Metal content (ppm) | Regulation failure | Charge quantity 1 (μC/g) | Charge quantity 2 (μC/g) | Fogging (%) |
|---|---|---|---|---|---|---|
| Example 1 | 5.7.E+06 | <1 | A | −5.2 | −39 | 1.0 |
| Example 2 | 5.2.E+06 | <1 | A | −4.4 | −33 | 2.0 |
| Example 3 | 1.4.E+07 | <1 | A | −5.0 | −39 | 0.9 |
| Example 4 | 2.7.E+06 | <1 | A | −5.3 | −40 | 0.9 |
| Example 5 | 3.8.E+05 | <1 | A | −5.2 | −39 | 0.9 |
| Example 6 | 4.7.E+06 | <1 | A | −4.4 | −32 | 1.8 |
| Example 7 | 9.5.E+06 | <1 | A | −5.3 | −40 | 0.9 |
| Example 8 | 9.4.E+06 | <1 | A | −4.3 | −33 | 1.8 |
| Example 9 | 4.7.E+06 | <1 | A | −5.4 | −40 | 1.1 |
| Example 10 | 4.4.E+06 | <1 | A | −5.2 | −40 | 1.0 |
| Example 11 | 6.0.E+06 | <1 | A | −5.2 | −39 | 0.9 |
| Example 12 | 6.2.E+06 | <1 | A | −4.3 | −32 | 1.9 |
| Example 13 | 4.1.E+06 | <1 | A | −4.4 | −34 | 1.7 |
| Example 14 | 6.8.E+06 | <1 | A | −5.2 | −39 | 1.0 |
| Example 15 | 5.7.E+06 | <1 | A | −5.2 | −39 | 1.1 |
| Example 16 | 7.4.E+06 | <1 | A | −5.3 | −40 | 0.9 |
| Example 17 | 7.4.E+06 | <1 | A | −5.3 | −40 | 0.9 |
| Example 18 | 4.5.E+06 | <1 | A | −4.5 | −34 | 1.7 |
| Example 19 | 6.7.E+06 | <1 | A | −4.5 | −34 | 1.7 |
| Example 20 | 3.4.E+07 | <1 | A | −4.4 | −32 | 1.9 |
| Example 21 | 6.4.E+06 | <1 | A | −4.4 | −33 | 1.8 |
| Example 22 | 1.8.E+06 | <1 | A | −4.5 | −33 | 1.7 |
| Example 23 | 5.7.E+06 | <1 | A | −4.5 | −33 | 1.7 |
| Example 24 | 5.4.E+06 | <1 | A | −4.4 | −33 | 1.7 |
| Example 25 | 5.7.E+06 | Li 50 ppm, Na 100 ppm | A | −4.5 | −34 | 1.6 |
| Example 30 | 1.8.E+06 | Fe 600 ppm | A | −5.4 | −40 | 1.0 |

TABLE 19-continued

| Example | Roller resistance value (Ω) | Metal content (ppm) | Regulation failure | Charge quantity 1 (μC/g) | Charge quantity 2 (μC/g) | Fogging (%) |
|---|---|---|---|---|---|---|
| Example 31 | 5.7.E+06 | Cu 600 ppm | A | −5.3 | −40 | 1.0 |
| Example 32 | 5.4.E+06 | Ag 500 ppm | A | −5.2 | −40 | 1.0 |
| Comparative Example 1 | 3.8.E+06 | <1 | A | −2.6 | −19 | 12.6 |
| Comparative Example 2 | 5.7.E+08 | <1 | C | −5.1 | −39 | 1.1 |
| Comparative Example 3 | 5.7.E+06 | Na 1,000 ppm | A | −2.9 | −22 | 7.2 |
| Comparative Example 4 | 5.7.E+06 | Li 700 ppm | A | −3.1 | −23 | 6.7 |
| Comparative Example 5 | 4.4.E+06 | <1 | A | −2.9 | −22 | 8.2 |
| Comparative Example 8 | 6.0.E+06 | Ba 650 ppm | A | −3.2 | −24 | 5.6 |
| Comparative Example 9 | 6.2.E+06 | Mg 550 ppm | A | −3.1 | −23 | 5.5 |
| Comparative Example 10 | 4.1.E+06 | Cs 600 ppm | A | −3.2 | −24 | 5.6 |
| Comparative Example 11 | 6.8.E+06 | K 800 ppm | A | −3.0 | −23 | 6.4 |

It should be noted that in Table 19, the description that the resistance value of a roller is "5.7.E+06" means that the electric resistance value of the roller is $5.7\times10^{6}\Omega$.

In each of the developing rollers according to Examples 1 to 25 and 30 to 32, no regulation failure occurs and a fogging value is less than 2% even under the H/H environment because the electroconductive layer of the roller contains a resin of a structure according to the present invention.

In contrast, in Comparative Example 2, a regulation failure occurred. It is assumed that the regulation failure occurred as a result of the fact that the electric resistance of the developing roller increased and hence the charging of a toner became nonuniform. In each of Comparative Examples 1, 3, 4, 5, and 8 to 11, fogging occurred. It is assumed that the fogging occurred owing to the fact that an ionic compound migrated to the surface of the electroconductive layer, with the result that the charge-providing performance of the developing roller reduced to preclude the charging of the toner to a predetermined charge quantity.

2. Evaluation as Charging Roller

The members for electrophotography according to Examples 26 and 27, and Comparative Example 6 were each used as a charging roller and evaluated for the following items.

<2-1. Resistance Value of Charging Roller>

The electric resistance value of a charging roller was measured in the same manner as in the section <1-1. Resistance Value of Developing Roller> except that the charging roller was used instead of a developing roller and the voltage to be applied was changed to 200 V.

<2-2. Content of Metal Element in Electroconductive Layer of Charging Roller>

The content of a metal element in the electroconductive layer of a charging roller was measured in the same manner as in the section <1-3. Content of Metal Element in Electroconductive Layer of Developing Roller> except that the charging roller was used instead of a developing roller.

<2-3. Evaluation of Horizontal Streak Image>

As the electric resistance of a charging roller increases, fine streak-like density unevenness may occur in a halftone image. The resultant image is referred to as "horizontal streak image." The horizontal streak image tends to deteriorate as the electric resistance of the charging roller increases, and may be caused by the adhesion of toner to the surface of the roller. In view of the foregoing, the member for electrophotography of the present invention was incorporated as a charging roller and the following evaluation was performed.

The charging roller according to Example 26 was left to stand under an environment having a temperature of 45° C. and a relative humidity of 95% for 14 days. After that, the charging roller was loaded into an electrophotographic laser printer (trade name: HP Color Laserjet Enterprise CP4515dn, manufactured by Hewlett-Packard Company). The laser printer was placed in the H/H environment and then left to stand for 2 hours. Next, a black image having a print density of 4% (such an image that horizontal lines each having a width of 2 dots were drawn in a direction vertical to the rotation direction of a photosensitive member at an interval of 50 dots) was output. After the image had been output on 100 sheets, a halftone image (such an image that horizontal lines each having a width of 1 dot were drawn in the direction vertical to the rotation direction of the photosensitive member at an interval of 2 dots) was output for an image check. The resultant image was visually observed and a horizontal streak was evaluated by the following criteria.

A: The level at which no horizontal streak occurs.

B: The level at which a horizontal streak slightly occurs only in an end portion of an image.

C: The level at which a horizontal streak occurs in a substantially half region of an image and is conspicuous.

TABLE 20

| Example | Roller resistance value (Ω) | Metal content (ppm) | Horizontal streak |
|---|---|---|---|
| Example 26 | 5.7.E+06 | <1 | A |
| Example 27 | 6.7.E+06 | <1 | A |
| Comparative Example 6 | 5.6.E+06 | Li 600 ppm | C |

In each of Examples 26 and 27, no horizontal streak occurred and a satisfactory image was obtained. In Comparative Example 6, a horizontal streak occurred probably because the performance of the charging roller to provide the toner with charge reduced to cause the toner to electrostatically adhere to the surface of the charging roller, with the result that the electric resistance of the surface of the charging roller increased to preclude uniform charging of the photosensitive member.

3. Evaluation as Developer-Regulating Member

The developing blades according to Examples 28 and 29, and Comparative Example 7 were each used as a developer-regulating member and evaluated for the following items.

<3-1. Electric Resistance Value of Developer-Regulating Member>

The electric resistance value of a developer-regulating member was measured under the N/N environment after the developer-regulating member had been left to stand in the N/N environment for 6 hours or more. The measurement of the electric resistance value of the developer-regulating member was performed as described below using the jig for evaluating a fluctuation in roller resistance value illustrated in FIG. 5A and FIG. 5B. In FIG. 5A, the developer-regulating member was fixed under a state in which supporting substrate portions at both ends of the developer-regulating member in each of which the resin layer had not been formed were each pressed with a load of 4.9 N through the intermediation of the electroconductive bearing 38 so as to be brought into contact with the columnar metal 37 having a diameter of 40 mm. Next, a voltage of 50 V was applied from the high-voltage power source 39, and a potential difference between both ends of a resistor having a known electrical resistance value (having an electrical resistance lower than the electrical resistance of the developer-regulating member by two orders of magnitude or more) placed between the columnar metal 37 and the ground was measured. The potential difference was measured using the voltmeter 40 (189TRUE RMS MULTIMETER manufactured by Fluke Corporation).

A current which had flowed through the developer-regulating member into the columnar metal 37 was determined by calculation based on the measured potential difference and the electrical resistance value of the resistor. The applied voltage of 50 V was divided by the resultant current to determine the electrical resistance value of the developer-regulating member. In the measurement of the potential difference, 2 seconds after the application of the voltage, sampling was performed for 3 seconds and a value calculated from the average value of the sampled data was defined as the electrical resistance value of the developer-regulating member.

<3-2. Content of Metal in Electroconductive Layer of Developer-Regulating Member>

The content of a metal in the electroconductive layer of a developer-regulating member was measured in the same manner as in the case of the section <1-3. Content of Metal Element in Electroconductive Layer of Developing Roller>.

<3-3. Triboelectric Charge Quantity of Developer-Regulating Member>

The triboelectric charge quantity of a developer-regulating member was measured in the same manner as in the section <1-2. Triboelectric Charge Quantity of Developing Roller> except that the developer-regulating member was used instead of a developing roller. It should be noted that the triboelectric charge quantity obtained by the developer-regulating member in this measurement was defined as a "charge quantity 1."

<3-4. Regulation Failure Evaluation, Fogging Image Evaluation, and Triboelectric Charge Quantity of Developer>

Respective evaluations and measurement were performed in the same manner as in the sections <1-4. Regulation Failure Evaluation>, <1-5. Fogging Image Evaluation>, and <1-6. Triboelectric Charge Quantity of Developer> of a developing roller except that the developing roller of the laser printer was not changed to the developing roller according to the present invention and any one of the developer-regulating members according to the examples was loaded. It should be noted that the triboelectric charge quantity obtained by the developer-regulating member in this measurement was defined as a "charge quantity 2."

TABLE 21

| Example | Resistance value (Ω) | Metal content (ppm) | Regulation failure | Charge quantity 1 (μC/g) | Charge quantity 2 (μC/g) | Fogging (%) |
|---|---|---|---|---|---|---|
| Example 28 | 6.8.E+06 | <1 | A | −4.5 | −38 | 0.9 |
| Example 29 | 4.9.E+06 | <1 | A | −5.2 | −33 | 0.8 |
| Comparative Example 7 | 2.7.E+08 | <1 | C | −4.1 | −37 | 0.9 |

In each of Examples 28 and 29, no regulation failure occurs under the L/L environment and a fogging value is less than 2% even under the H/H environment because the electroconductive layer contains a resin of a structure according to the present invention. In contrast, in Comparative Example 7, a regulation failure occurred. It is assumed that the regulation failure under the L/L environment occurred as a result of the fact that the electric resistance of the developer-regulating member increased to preclude the application of a voltage having a predetermined value to the developer-regulating member, and hence the charging of the toner became nonuniform.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-265946, filed Dec. 26, 2014 which is hereby incorporated by reference herein in its entirety.

What is claimed is:

1. A member for electrophotography, comprising:

an electroconductive substrate; and an electroconductive layer on the substrate, wherein the electroconductive layer contains a resin having a cationic organic group in a molecule thereof and an anion;

a total sum of contents of an alkali metal and an alkali earth metal in the electroconductive layer is 500 ppm or less; and the anion comprises at least one selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion.

2. A member for electrophotography according to claim 1, wherein the resin contains a polymer chain having a branched structure, and the cationic organic group is present in the branched structure of the polymer chain.

3. A process cartridge, comprising members for electrophotography, the process cartridge being removably mounted onto a main body of an electrophotographic apparatus, wherein at least one of the members for electrophotography comprises the member for electrophotography according to claim 1.

4. An electrophotographic apparatus, comprising members for electrophotography, wherein at least one of the members for electrophotography comprises the member for electrophotography according to claim 1.

5. A member for electrophotography, comprising:

an electroconductive substrate; and an electroconductive layer on the substrate, a total sum of contents of an alkali metal and an alkali earth metal in the electroconductive layer being 500 ppm or less, wherein the electroconductive layer contains one of the following resin (a) and resin (b):

resin (a) being a resin that comprises a product of a reaction between an ionic electroconductive agent and a first compound capable of reacting with a hydroxyl group, the ionic electroconductive agent containing an anion and a cation having 2 or more hydroxyl groups, the anion comprising at least one selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion, and resin (b) being a product of a reaction between a second compound having 3 or more nitrogen atoms of a tertiary amine in a molecule thereof, and a third compound having, in a molecule thereof, 2 or more groups of at least one of kinds represented by $—N(SO_2R^1)_2$ and $—OSO_2R^2$ where $R^1$ and $R^2$ each independently represent a fluorine atom or a perfluoroalkyl group having 1 to 5 carbon atoms.

6. A member for electrophotography according to claim 5, wherein the ionic electroconductive agent contains the anion and a cation having 3 or more hydroxyl groups.

7. A member for electrophotography according to claim 6, wherein the ionic electroconductive agent comprises one of the following (1) and (2):

(1) a product of a reaction between one selected from the group consisting of a hydroxide, a methyl carbonate, an ethyl carbonate, a propyl carbonate, and a hydrogen carbonate of the cation, and a conjugate acid of the anion; and (2) a product of a reaction between one selected from the group consisting of a fluorosulfonate, a fluorocarboxylate, and an N-alkylbis(fluorosulfonyl)imide, and a tertiary amine compound.

8. A member for electrophotography according to claim 5, wherein the third compound comprises at least one selected from compounds represented by the chemical formulae (1) to (4):

Chemical formula (1)

Chemical formula (2)

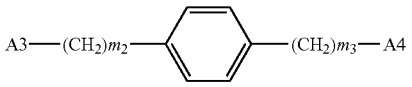

Chemical formula (3)

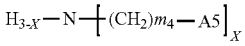

Chemical formula (4)

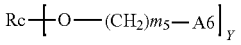

where A1 to A6 each independently represent $—N(SO_2R^1)_2$ or $—OSO_2R^2$, Ra and Rb each independently represent a hydrogen atom or an alkyl group that may have a substituent, Rc represents an alkyl group that may have a substituent, $m_1$ represents an integer of from 1 to 30, $m_2$ to $m_5$ each independently represent an integer of from 1 to 15, X represents 2 or 3, and Y represents an integer of from 2 to 10, and $R^1$ and $R^2$ each independently represent a fluorine atom or a perfluoroalkyl group having 1 to 5 carbon atoms.

9. A member for electrophotography according to claim 8, wherein the third compound comprises a compound represented by the chemical formula (1).

10. A method of producing a member for electrophotography, the member for electrophotography including an electroconductive substrate and an electroconductive layer on the substrate, the electroconductive layer containing a resin having a cationic organic group in a molecule thereof and an anion, the electroconductive layer containing an alkali metal and an alkali earth metal at a total sum of contents of 500 ppm or less, the anion comprising at least one selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion, the method comprising:

(1) forming, on the electroconductive substrate, a coating film of a paint containing a cation having 2 or more hydroxyl groups and a compound capable of reacting with a hydroxyl group; and (2) causing the cation having 2 or more hydroxyl groups and the compound capable of reacting with a hydroxyl group in the coating film to react with each other to form the electroconductive layer.

11. A method of producing a member for electrophotography according to claim 10, further comprising preparing an ionic electroconductive agent having the cation having 2 or more hydroxyl groups and the anion prior to the step (1).

12. A method of producing a member for electrophotography according to claim 11, wherein the preparation of the ionic electroconductive agent includes causing a compound having the cation having 2 or more hydroxyl groups and a hydroxide anion, and a compound having the anion and a proton to react with each other.

13. A method of producing a member for electrophotography according to claim 12, wherein the compound having the cation having 2 or more hydroxyl groups and the hydroxide anion comprises at least one selected from tris(hydroxyethyl)methylammonium hydroxide, and bis(hydroxyethyl)dimethylammonium hydroxide.

14. A method of producing a member for electrophotography according to claim 12, wherein the compound having the anion and the proton comprises at least one selected from bis(trifluromethanesulfonyl)amide, bis(nonafluorobutanesulfonyl)amide, 4,4,5,5,6,6-hexafluorodihydro-4H-1,3,2-dithiazine 1,1,3,3-tetraoxide, trifluoromethanesulfonic acid, nonafluorobutanesulfonic acid, trifluoroacetic acid, heptafluorobutyric acid, tris(trifluoromethanesulfonyl)methide, and trifluoromethyltrifluoroboric acid.

15. A method of producing a member for electrophotography according to claim 10, wherein the preparation of the ionic electroconductive agent includes causing a tertiary amine compound and an imide compound of the anion to react with each other.

16. A method of producing a member for electrophotography according to claim 15, wherein the tertiary amine compound comprises at least one selected from N-methyldiethanolamine, triethanolamine, 2-pyridineethanol, 1-hydroxyethyl-2-hydroxymethylimidazole, N-hydroxyethylpyrrolidone, and N-hydroxyethylpiperidine.

17. A method of producing a member for electrophotography according to claim 15, wherein the imide compound of the anion comprises at least one selected from N-methylbis(trifluoromethylsulfonyl)imide, and N-hydroxyethylbis(trifluoromethylsulfonyl)imide.

18. A method of producing a member for electrophotography according to claim 10, wherein the preparation of the ionic electroconductive agent includes causing one of an alkyl carbonate of the cation having 2 or more hydroxyl groups and a hydrogen carbonate of the cation, and a compound having the anion and a proton to react with each other.

19. A method of producing a member for electrophotography, the member for electrophotography including an electroconductive substrate and an electroconductive layer on the substrate, the electroconductive layer containing a resin having a cationic organic group in a molecule thereof and an anion, the electroconductive layer containing an alkali metal and an alkali earth metal at a total sum of contents of 500 ppm or less, the anion comprising at least one selected from the group consisting of a fluorosulfonate anion, a fluorocarboxylate anion, a fluorosulfonylimide anion, a fluorosulfonylmethide anion, a fluoroalkylfluoroborate anion, a fluorophosphate anion, a fluoroantimonate anion, and a fluoroarsenate anion, the method comprising:

(1) forming, on the electroconductive substrate, a coating film of a paint containing a compound having 3 or more nitrogen atoms of a tertiary amine, and a compound having, in a molecule thereof, 2 or more groups of at least one of kinds represented by $—N(SO_2R^1)_2$ and $—OSO_2R^2$ where $R^1$ and $R^2$ each independently represent a fluorine atom or a perfluoroalkyl group having 1 to 5 carbon atoms; and (2) causing the compound having 3 or more nitrogen atoms of a tertiary amine, and the compound having, in a molecule thereof, 2 or more groups of at least one of kinds represented by $—N(SO_2R^1)_2$ and $—OSO_2R^2$ where $R^1$ and $R^2$ each independently represent a fluorine atom or a perfluoroalkyl group having 1 to 5 carbon atoms in the coating film to react with each other to form the electroconductive layer.

20. A method of producing a member for electrophotography according to claim 19, wherein:

the compound having 3 or more nitrogen atoms of a tertiary amine comprises at least one selected from the group consisting of poly(1-vinylimidazole), poly(4-vinylpyridine), and poly(dimethylaminoethyl methacrylate); and the compound having, in a molecule thereof, 2 or more groups of at least one of kinds represented by $—N(SO_2R^1)_2$ and $—OSO_2R^2$ comprises at least one selected from the group of compounds represented by the following chemical formulae (1) to (4):

Chemical formula (1)

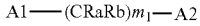

Chemical formula (2)

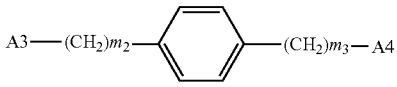

Chemical formula (3)

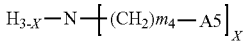

Chemical formula (4)

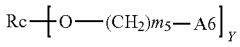

where A1 to A6 each independently represent $—N(SO_2R^1)_2$ or $—OSO_2R^2$, Ra and Rb each independently represent a hydrogen atom or an alkyl group that may have a substituent, Rc represents an alkyl group that may have a substituent, $m_1$ represents an integer of from 1 to 30, $m_2$ to $m_5$ each independently represent an integer of from 1 to 15, X represents 2 or 3, Y represents an integer of from 2 to 10, and $R^1$ and $R^2$ each independently represent a fluorine atom or a perfluoroalkyl group having 1 to 5 carbon atoms.

* * * * *